US007452651B2

(12) United States Patent
Hotta et al.

(10) Patent No.: US 7,452,651 B2
(45) Date of Patent: Nov. 18, 2008

(54) CARRIER, TWO-COMPONENT DEVELOPER, AND IMAGE FORMING METHOD

(75) Inventors: Yojiro Hotta, Mishima (JP); Tetsuya Ida, Mishima (JP); Wakashi Iida, Toride (JP); Akira Hashimoto, Shizuoka-ken (JP); Nozomu Komatsu, Susono (JP); Yoshinobu Baba, Yokohama (JP)

(73) Assignee: Canon Kabushiki Kaisha (JP)

( * ) Notice: Subject to any disclaimer, the term of this patent is extended or adjusted under 35 U.S.C. 154(b) by 451 days.

(21) Appl. No.: 11/268,675

(22) Filed: Nov. 7, 2005

(65) Prior Publication Data

US 2006/0127793 A1 Jun. 15, 2006

(30) Foreign Application Priority Data

Nov. 5, 2004 (JP) ..... 2004-321564

(51) Int. Cl.
*G03G 9/00* (2006.01)

(52) U.S. Cl. ..... 430/111.33; 430/122.2; 430/123.58

(58) Field of Classification Search ..... 430/111.33, 430/122.2, 123.58
See application file for complete search history.

(56) References Cited

U.S. PATENT DOCUMENTS 5,629,120 A * 5/1997 Serizawa et al. ..... 430/111.33

FOREIGN PATENT DOCUMENTS

| | | | |
|---|---|---|---|
| JP | 64-20587 | A | 1/1989 |
| JP | 2-259784 | A | 10/1990 |
| JP | 4-050886 | A | 2/1992 |
| JP | 5-069427 | A | 3/1993 |
| JP | 5-165378 | A | 7/1993 |
| JP | 7-225497 | A | 8/1995 |
| JP | 7-333910 | A | 12/1995 |
| JP | 8-292607 | A | 11/1996 |
| JP | 10-104884 | A | 4/1998 |
| JP | 2001-154416 | A | 6/2001 |
| JP | 2002-287431 | A | 10/2002 |
| JP | 2003-156887 | A | 5/2003 |

* cited by examiner

*Primary Examiner*—Mark A Chapman
(74) *Attorney, Agent, or Firm*—Rossi, Kimms & McDowell LLP

(57) ABSTRACT

In a carrier comprising carrier particles; each carrier particle comprising a carrier core and a coat layer for coating the carrier core, the carrier core has a ferrite component containing i) a metal oxide having at least one of metallic elements Mg, Li and Ca, the total-sum content of which is 10 to 40 mole % based on the whole ferrite component, and ii) a metal oxide having at least one of metallic elements Mn, Cu, Cr and Zn, the total-sum content of which is 50 to 4,000 ppm based on the whole ferrite component. The carrier has a volume distribution based 50% particle diameter (D50) of from 15.0 to 55.0 μm and a degree of surface unevenness of from 1.05 to 1.30, and the coat layer contains particles; the particles having a number-average primary particle diameter of from 10 to 500 nm.

15 Claims, 5 Drawing Sheets

CARRIER, TWO-COMPONENT DEVELOPER, AND IMAGE FORMING METHOD

BACKGROUND OF THE INVENTION

1. Field of the Invention

This invention relates to a carrier used in a developer for developing electrostatic latent images in electrophotography, electrostatic recording, electrostatic printing or toner jet recording, a two-component developer having the carrier and a toner, and an image forming method making use of the two-component developer.

2. Related Background Art

A number of methods are known as methods for image forming processes. In particular, it is common to use an image forming method like the following: First, an electrostatic latent image is formed on a photosensitive member by various means utilizing a photoconductive material. Subsequently, the latent image is developed by the use of a toner to form a toner image as a visible image. Then, the toner image is transferred to a recording material such as paper as occasion calls, and thereafter the toner image is fixed by the action of heat and/or pressure to obtain a copy. The toner that has not transferred to and has remained on the photosensitive member is removed by cleaning by various methods, and then the above process is repeated.

In recent years, image forming apparatus making use of such an image forming method have severely been in pursue toward smaller size, lighter weight, higher speed and higher reliability. Also, such image forming apparatus not only have been used merely as copying machines for office working to take copies of originals as commonly done, but also have begun to be used as digital printers for outputting data from computers or used for copying highly minute images such as graphic designs.

As to the step of cleaning the photosensitive member, cleaning means such as blade cleaning, fur brush cleaning and roller cleaning have conventionally been used. Such cleaning means are those by which the transfer residual toner on the photosensitive member is scraped off or blocked up so that it can be collected in a waste toner container. Hence, because of the fact that the member constituting such a cleaning means is brought into pressure touch with the surface of the photosensitive member, problems have tended to arise. For example, bringing a cleaning member into strong pressure touch causes the surface of the photosensitive member to wear. Moreover, the whole apparatus must be made larger in order to provide such a cleaning means. This has been a bottleneck in attempts to make apparatus compact. In addition, from the viewpoint of ecology, a system that may produce no waste toner is long-awaited.

To solve the above problems, an image forming apparatus is proposed which employs a technique called "cleaning-at-development" (cleaning performed simultaneously at the time of development) or "cleanerless" (see, e.g., Japanese Patent Publication No. H05-69427). In this image forming apparatus, one image is formed at one rotation of the photosensitive member so that any effect of transfer residual toner does not appear on the same image. A technique is also proposed in which the transfer residual toner is dispersed or driven off by a drive-off member to make it into non-patterns so that it may hardly appear on images even when the surface of the same photosensitive member is utilized several times for one image (see, e.g., Japanese Patent Applications Laid-open No. S64-20587, No. H02-259784, No. H04-50886 and No. H05-165378).

As a need of users in these days, it is also sought to achieve higher image quality and higher minuteness. As a means for achieving it, what prevails is to make toners into fine particles. Making toners into fine particles is certainly greatly effective in the sense that latent images are faithfully reproduced. However, fog must be remedied in order to provide stable images over a long period of time. This is namely because making toners have a smaller particle diameter makes the toners have a larger particle surface area, resulting in a broad charge quantity distribution, and this tends to cause fog. Making toners have a larger particle surface area makes charge characteristics of toners more tend to be influenced by environment. Further, making toners have a small particle diameter makes the state of dispersion of a charge control agent or a colorant have great influence on the chargeability of toners. When such toners having a small particle diameter are used in high-speed machines, excess charging may result especially in an environment of low humidity to cause fog or a decrease in density.

Where such toners having a small particle diameter are used, faulty cleaning tends to occur in a system in which the transfer residual toner on the photosensitive member is removed by cleaning. On the other hand, in the above cleanerless system, transfer residual toner due to fogging toner may increase, and its presence may inhibit the photosensitive member from being charged at its charging portions, to cause fog more seriously, making it difficult to provide high-grade images.

As measures to achieve higher image quality and environmental measures to be taken so as not to generate ozone, a system of contact charging such as roller charging has become prevalent as a method of charging the photosensitive member, in place of conventional corona charging. In an aspect of image quality, in the case of the corona charging, it has come about that the toner having scattered tends to contaminate charging wires to make their discharge insufficient at the areas thus contaminated, and this makes it difficult for the photosensitive member (drum) to be provided with a stated potential. Hence, an image defect called line images tends to occur in the contact charging system as well, a charging system in which an alternating current is applied superimposingly on direct-current charging is employed from the viewpoint that the photosensitive member which is a latent image baring member is to be sufficiently charged over a long period of time.

The charging system in which an alternating current is applied superimposingly on direct-current charging can maintain high image quality over a long period time. However, because of the application of an alternating current component, the toner having been interposingly present at the charging portions tends to adhere strongly to the charging member or the photosensitive member. Where the toner has adhered to the photosensitive member, it comes to what is called toner melt adhesion. Where the toner has adhered to the charging member, it causes faulty-charging. Both the cases result in image defects corresponding to the areas to which the toner has adhered. Thus, although various proposals have been made as systems, some problems still remain unsolved in regard to developers suited for the matching with such systems.

Two-component developers, the carrier of which has the function to agitate, transport and charge the toner, are functionally separated as developers, and hence characterized by, e.g., having a good controllability. Accordingly, they are in wide use at present. In particular, they are preferably be used in full-color image forming apparatus such as full-color copying machines and full-color printers, for which a high image quality is demanded.

As magnetic carriers used in the two-component developers, an iron powder carrier, a ferrite carrier and a magnetic-material dispersed resin carrier in which fine magnetic-material particles are dispersed in a binder resin are known in the art. As to the iron powder carrier among these, the carrier has so low a specific resistance that electric charges of electrostatic latent images may leak through the carrier to disorder the electrostatic latent images to cause image defects. Accordingly, as magnetic carriers, the ferrite carrier and the magnetic-material dispersed resin carrier are in wide use at present.

The magnetic-material dispersed resin carrier has advantages such that it has a small specific gravity and can lower agitation torque. Lessening damage to the carrier at the time of agitation prevents carrier-spent from occurring. However, although the developer can be made to have a long lifetime, such a carrier may have an insufficient uniformity in magnetic properties. Hence, this has tended to cause carrier adhesion to tend to cause image defects.

In conventional ferrite carriers, heavy-metal-containing ferrite carriers have commonly been used. In that case, however, the carrier has so large a specific gravity and further has so large a saturation magnetization that it may provide a rigid magnetic brush to have tended to cause deterioration of the developer, such as carrier-spent and deterioration of external additives of toner, and also cause sweep marks of the magnetic brush. Accordingly, light-metal ferrite carriers aiming at lowering specific gravity are disclosed (see, e.g., Japanese Patent Applications Laid-open No. 2001-154416, No. H07-225497 and No. H07-333910). However, these are all ferrite carriers constituted of only light metals, and their constituents have a poor mutual adhesion to have an insufficient particle strength. In particular, in the cleanerless system, a large stress is applied to the developer at the time of agitation in order to secure a good rise of toner charging. Hence, irregular-shape particles tend to be present to tend to cause faulty images.

In addition, in the conventional ferrite carriers, how to manage their particle surface properties is given as a point of concern. Hitherto, a method has been employed in which firing temperature at the time of production is made higher in order to smoothen ferrite carrier particle surfaces having microscopic unevenness. Such a method, however, may cause coalescence between particles to tend to cause faulty images. To cope with this, ferrite carrier particle surfaces having microscopic unevenness are coated with a resin in a large quantity to smoothen carrier particle surfaces to provide the carrier with fluidity and prevent carrier-spent (see, e.g., Japanese Patent Applications Laid-open No. H08-292607 and No. 2003-156887). This method, however, requires the addition of the coat material in a quantity large enough to smoothen the carrier particle surfaces. Hence, the charging of toner may rise so excessively as to provide insufficient image density or cause ground fog. It is also attempted to conversely make the microscopic unevenness present on the carrier particle surfaces by the use of the coat material, to improve charge-providing performance (see, e.g., Japanese Patent Applications Laid-open No. 2002-287431 and No. H10-104884). In this method, however, layers that form the microscopic unevenness may come off as a result of long-term service to cause a problem on durability of the carrier.

Thus, it is sought after to provide a carrier which promises a good rise of charging that is adaptable to the cleanerless system and can maintain a high image quality over a long period of time.

In order to keep toners from changing in charge quantity and to achieve the stabilization of image density, an image forming method is also proposed in which, when the toner consumed as a result of development is replenished, the carrier is replenished together with the toner so that the carrier in a developing assembly can be changed little by little for new one. In such an image forming method as well, it is sought after to provide a carrier which promises a good rise of charging and can maintain a high image quality over a long period of time.

SUMMARY OF THE INVENTION

An object of the present invention is to provide a carrier which has solved the above problems and can contribute to the stable formation of images having satisfied high minuteness. More specifically, it is to provide a magnetic carrier which is adaptable also to the cleanerless system, has a superior charge-providing performance, also has a broad latitude against can contribute to high-quality images free of fog and density non-uniformity over a wide range of from low area percentage images to high area percentage images, also has a superior environmental stability, and still also has a high running performance, and to provide a two-component developer and an image forming process which make use of such a magnetic carrier.

The present invention is that which has been able to solve the above problems by employing the following constitution.

The present invention is concerned with a carrier comprising carrier particles;

each carrier particle comprising at least a carrier core and a coat layer for coating the carrier core, wherein;

the carrier core has a ferrite component, and the ferrite component contains i) a metal oxide having at least one metallic element selected from the group consisting of Mg, Li and Ca, where the total-sum content of the metal oxide having at least one of the metallic elements Mg, Li and Ca is from 10 to 40 mole % based on the whole ferrite component, and ii) a metal oxide having at least one metallic element selected from the group consisting of Mn, Cu, Cr and Zn, where the total-sum content of the metal oxide having at least one of the metallic elements Mn, Cu, Cr and Zn is from 50 to 4,000 ppm on mass basis based on the whole ferrite component;

the carrier has a volume distribution based 50% particle diameter (D50) of from 15.0 to 55.0 μm;

the carrier has a degree of surface unevenness of from 1.05 to 1.30; and the coat layer contains particles, and the particles have a number-average primary particle diameter of from 10 to 500 nm.

The present invention is also concerned with a two-component developer having a toner containing at least a binder resin and a colorant and a carrier comprising carrier particles;

each carrier particle comprising at least a carrier core and a coat layer for coating the carrier core, wherein;

the carrier core has a ferrite component, and the ferrite component contains i) a metal oxide having at least one metallic element selected from the group consisting of Mg, Li and Ca, where the total-sum content of the metal oxide having at least one of the metallic elements Mg, Li and Ca is from 10 to 40 mole % based on the whole ferrite component, and ii) a metal oxide having at least one metallic element selected from the group consisting of Mn, Cu, Cr and Zn, where the total-sum content of the metal oxide having at least one of the metallic elements Mn, Cu, Cr and Zn is from 50 to 4,000 ppm on mass basis based on the whole ferrite component;

the carrier has a volume distribution based 50% particle diameter (D50) of from 15.0 to 55.0 μm;

the carrier has a degree of surface unevenness of from 1.05 to 1.30; and the coat layer contains particles, and the particles have a number-average primary particle diameter of from 10 to 500 nm.

The present invention is still also concerned with an image forming method having a charging step of charging the surface of a photosensitive member electrostatically; a latent-image forming step of forming an electrostatic latent image on the photosensitive member surface thus charged; a developing step of feeding a toner to the electrostatic latent image by the action of an electric field formed between i) a two-component developer held in a developing unit and ii) the photosensitive member to render the electrostatic latent image visible to form a toner image; a transfer step of transferring the toner image onto a transfer material via, or not via, an intermediate transfer member; and a fixing step of making the transfer material pass a nip formed by a fixing member and a pressure member pressed against the fixing member, to fix the toner image to the transfer material with heating and in pressure contact;

the steps being repeated to perform image formation; the charging step being carried out after a charge quantity control step has been carried out in which a transfer residual toner having remained on the photosensitive member surface after the transfer step is charged to a regular polarity; and the transfer residual toner being collected in the developing step; and the two-component developer having a toner containing at least a binder resin and a colorant and a carrier comprising carrier particles;

each carrier particle comprising at least a carrier core and a coat layer for coating the carrier core, wherein;

the carrier core has a ferrite component, and the ferrite component contains i) a metal oxide having at least one metallic element selected from the group consisting of Mg, Li and Ca, where the total-sum content of the metal oxide having at least one of the metallic elements Mg, Li and Ca is from 10 to 40 mole % based on the whole ferrite component, and ii) a metal oxide having at least one metallic element selected from the group consisting of Mn, Cu, Cr and Zn, where the total-sum content of the metal oxide having at least one of the metallic elements Mn, Cu, Cr and Zn is from 50 to 4,000 ppm on mass basis based on the whole ferrite component;

the carrier has a volume distribution based 50% particle diameter (D50) of from 15.0 to 55.0 μm;

the carrier has a degree of surface unevenness of from 1.05 to 1.30; and the coat layer contains particles, and the particles have a number-average primary particle diameter of from 10 to 500 nm.

The present invention is further concerned with an image forming method comprising forming an electrostatic latent image on an electrostatic latent image bearing member, forming a magnetic brush out of a toner and a carrier on a developer carrying member internally provided with a magnetic-field generating means, and developing the electrostatic latent image by means of the magnetic brush formed on the developer carrying member, to form a toner image on the electrostatic latent image bearing member;

the magnetic brush having the toner in an amount of from 2 to 20 parts by weight based on 100 parts by weight of the carrier; a replenishing developer being fed to a developing assembly, and the carrier that has become excess in the interior of the developing assembly being discharged out of the developing assembly; and the replenishing developer being a two-component developer having a toner containing at least a binder resin and a colorant and a carrier comprising carrier particles;

each carrier particle comprising at least a carrier core and a coat layer for coating the carrier core, wherein;

the carrier core has a ferrite component, and the ferrite component contains i) a metal oxide having at least one metallic element selected from the group consisting of Mg, Li and Ca, where the total-sum content of the metal oxide having at least one of the metallic elements Mg, Li and Ca is from 10 to 40 mole % based on the whole ferrite component, and ii) a metal oxide having at least one metallic element selected from the group consisting of Mn, Cu, Cr and Zn, where the total-sum content of the metal oxide having at least one of the metallic elements Mn, Cu, Cr and Zn is from 50 to 4,000 ppm on mass basis based on the whole ferrite component;

the carrier has a volume distribution based 50% particle diameter (D50) of from 15.0 to 55.0 μm;

the carrier has a degree of surface unevenness of from 1.05 to 1.30; and the coat layer contains particles, and the particles have a number-average primary particle diameter of from 10 to 500 nm.

The magnetic carrier of the present invention can contribute to the stable formation of images having satisfied high minuteness. More specifically, it is adaptable also to the cleanerless system, has a superior charge-providing performance, also has a broad latitude against carrier-spent, can contribute to high-quality images free of fog and density non-uniformity over a wide range of from low area percentage images to high area percentage images, also has a superior environmental stability, and still also can have a high running performance.

DESCRIPTION OF THE PREFERRED EMBODIMENTS

Figure 1:
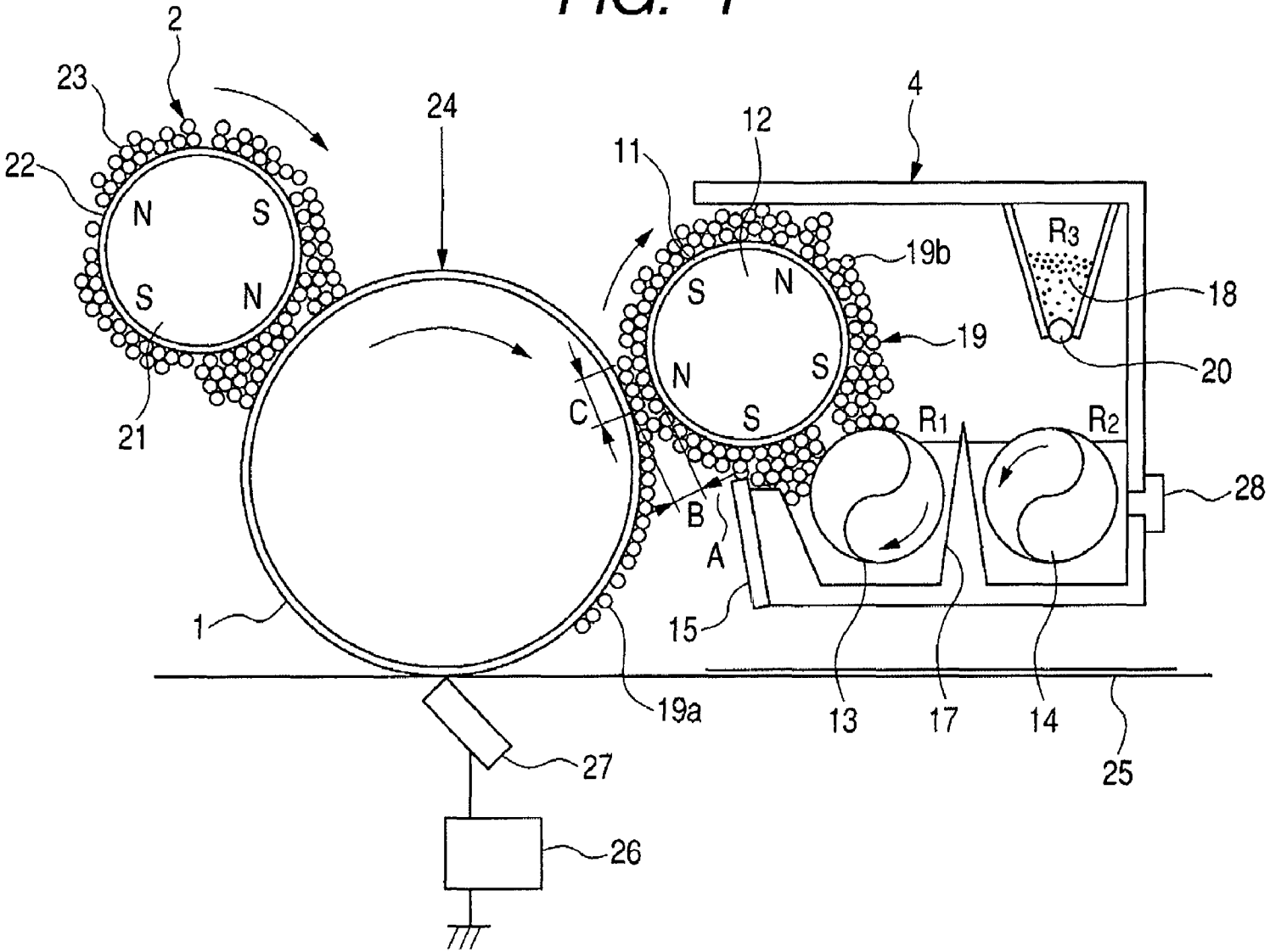
FIG. 1 is a partial diagrammatic view showing an example of an image forming apparatus in which the image forming method of the present invention is preferably used.

The present invention is a carrier comprising carrier particles; each carrier particle comprising at least a carrier core and a coat layer for coating the carrier core, characterized in that the carrier core has a ferrite component, and the ferrite component contains i) a metal oxide having at least one metallic element selected from the group consisting of Mg, Li and Ca, where the total-sum content of the metal oxide having at least one of the metallic elements Mg, Li and Ca is from 10 to 40 mole % based on the whole ferrite component, and ii) a metal oxide having at least one metallic element selected from the group consisting of Mn, Cu, Cr and Zn, where the total-sum content of the metal oxide having at least one of the metallic elements Mn, Cu, Cr and Zn is from 50 to 4,000 ppm based on the whole ferrite component; the carrier has a volume distribution based 50% particle diameter (D50) of from 15.0 to 55.0 μm;

the carrier has a degree of surface unevenness of from 1.05 to 1.30; and the coat layer contains particles, and the particles have a number-average primary particle diameter of from 10 to 500 nm. The use of this carrier has been found to make it possible to provide a carrier which can endow toners with a high charging rise performance and also has a superior durability.

In the present invention, the ferrite component is characterized in that it contains a metal oxide having at least one metallic element selected from the group consisting of Mg, Li and Ca, and that the total-sum content of the metal oxide having at least one of the metallic elements Mg, Li and Ca is from 10 to 40 mole % based on the whole ferrite component. This enables control of the specific gravity of the magnetic carrier to make it smaller than conventional one. Hence, the carrier is well blendable with the toner also in the cleanerless system, makes the toner enjoy a good rise of charging, also lessens the stress to be applied to the carrier when blended with the toner, and can provide stable images for a long term.

If heavy-metal oxides having heavy metallic elements such as Mn, Cu, Cr and Zn are contained in a large quantity as disclosed in the publications Japanese Patent Applications Laid-open No. H08-292607, No. 2002-287431 and No. 10-104884, the carrier has so high a specific gravity that the magnetic brush may come rigid. Especially in the cleanerless system, in which it is important how the toner undergoes the rise of charging, the carrier and the toner must strongly be agitated when blended. Hence, an impact more than what is necessary may inevitably be applied to the magnetic carrier, so that its durability does not last in some cases.

The total-sum content of the metal oxide having at least one of the metallic elements Mg, Li and Ca may preferably be from 13 to 35 mole %, and more preferably from 15 to 30 mole %.

The ferrite component is also characterized in that it contains a metal oxide having at least one metallic element selected from the group consisting of Mn, Cu, Cr and Zn, and that the total-sum content of the metal oxide having at least one of the metallic elements Mn, Cu, Cr and Zn is from 50 to 4,000 ppm based on the whole ferrite component. In the ferrite component, $Fe_2O_3$ is contained as an essential component, and hence not only the light-metal oxide having at least one of the light metallic elements Mg, Li and Ca is contained, but also the heavy-metal oxide is contained in a trace quantity. This enhances the uniformity of materials. Hence, the carrier can have uniform strength and magnetic force. In the carrier constituted of only light-metal oxides and $Fe_2O_3$ as disclosed in the publications Japanese Patent Applications Laid-open No. H07-225497, No. H07-333910 and No. H8-292607, the uniformity of materials at the time of production can not be maintained, resulting in an insufficient uniformity of the strength and magnetic force of carrier particles to cause faulty images due to carrier adhesion and so forth.

The total-sum content of the metal oxide having at least one of the metallic elements Mn, Cu, Cr and Zn may preferably be from 50 ppm or more to less than 4,000 ppm, more preferably from 50 to 3,500 ppm, and most preferably from 50 to 3,000 ppm.

The carrier is also characterized in that it has a volume distribution based 50% particle diameter (D50) of from 15.0 to 55.0 μm. If it has a D50 of more than 55.0 μm, the carrier may insufficiently provide the toner with uniform and good charge to not only make it difficult to reproduce latent images faithfully, but also cause fog or toner scatter. If on the other hand it has a D50 of less than 15.0 μm, the carrier may seriously adhere to the latent image bearing member. As a preferable volume distribution based 50% particle diameter (volume-average particle diameter), it may be from 15.0 μm or more to less than 55.0 μm, more preferably from 20.0 to 50.0 μm, and most preferably from 25.0 to 45.0 μm.

It is further preferable that, as particle size distribution of the carrier, particles of 15 μm or less in diameter are 10% by volume or less, those of 20 μm or less are 30% by volume or less, those of 50 μm or more are 30% by volume or less, and those of 65 μm or more are 50% by volume or less. If particles on the side of fine particles with smaller diameters are present in a large quantity, the carrier may seriously adhere to the latent image bearing member, or the developer may have a poor fluidity to tend to be non-uniformly coated on the developer carrying member. Hence, not only image density tends to come non-uniform, but also electrostatic latent images tend to be disordered through the carrier. If particles on the side of coarse particles are present in a large quantity, the carrier may insufficiently provide the toner with uniform and good charge to not only make it difficult to reproduce latent images faithfully, but also cause the shortage of lifetime of the developer especially in an environment of high humidity.

The carrier is also characterized in that it has a degree of surface unevenness of from 1.05 to 1.30. Fine unevenness is present on the ferrite carrier particle surfaces because of crystal growth in forming the particles. If such unevenness is present after carrier core has been coated, toner fine powder may adhere to dales of the unevenness, so that the carrier surfaces come smooth to tend to cause carrier-spent. Hence, the carrier may preferably have a smooth particle surface after the carrier core has been coated. Especially in the cleanerless system, it has such construction that a stress tends to be applied to the developer in order for the toner to be improved in the rise of charging. Accordingly, in the carrier disclosed in the publications Japanese Patent Applications Laid-open No. 2002-287431 and No. H10-104884, having unevenness on the carrier particle surfaces, the carrier particle surfaces may come off to make it difficult to maintain durability. Also, if the carrier particles are truly spherical to be too smooth, the carrier and the toner may come into contact in a too small contact area to make it difficult for the toner to be properly charged. The carrier may more preferably have a degree of surface unevenness of from 1.10 to 1.25.

Further, it is preferable for the carrier cores to have a degree of surface unevenness of from 1.05 to 1.40, and more preferably from 1.10 to 1.35. As to the carrier cores, it is more preferable for the surface unevenness to be present, because the particles are added to a carrier coat material described later. Also, the presence of unevenness on the carrier core surfaces makes them have a low specific gravity, and this is more favorable. However, if the carrier cores have a degree of surface unevenness of from 1.40 or more, there may be too many voids even if the carrier cores are coated with a coat resin, and the toner comes accumulated at such portions, so that the toner tends to be non-uniformly charged, undesirably.

The carrier may also preferably have a saturation magnetization of from 30 to 80 $Am^2/kg$, and a residual magnetization of 10 $Am^2/kg$ or less, under application of a magnetic field of 240 kA/m. Its saturation magnetization may more preferably be from 35 to 70 $Am^2/kg$, and still more preferably be from 40 to 65 $Am^2/kg$. Its residual magnetization may more preferably be 7 $Am^2/kg$ or less, and still more preferably be 5 $Am^2/kg$ or less.

If it has a saturation magnetization of more than 80 $Am^2/kg$, the rise of ears on the magnetic brush may come stiff, and the carrier may apply a large impact to a developer control blade and the like at the time of agitation to make it difficult to maintain durability. If it has a saturation magnetization of less than 30 $Am^2/kg$, carrier scatter may occur. Also, if the residual magnetization varies from the above value, developer transport performance in the developing assembly tends to become unstable, resulting in an inferior durability in some cases. If the carrier has a residual magnetization of more than 10 $Am^2/kg$, the developer may have a poor fluidity.

The carrier may preferably have an apparent density of from 1.30 to 2.40 $g/cm^3$, and more preferably from 1.50 to 2.00 $g/cm^3$. If it has an apparent density of more than 2.40 $g/cm^3$, the carrier may apply a large stress to the developer to cause toner deterioration during running. If on the other hand it has an apparent density of less than 1.30 $g/cm^3$, the carrier may come to adhere to the photosensitive member.

As methods for producing carrier core particles, known methods may be employed. For example, first, metal oxides, iron oxide ($Fe_2O_3$) and additives are weighed in stated quantities and mixed. Next, the mixture obtained is calcined for 0.5 to 5 hours in the temperature range of from 700 to 1,000° C. Thereafter, the calcined product is pulverized to have particle diameters of approximately from 0.3 to 3 μm. The pulverized product obtained is, with further optional addition of a binding agent and further a blowing agent, spray-dried in a heated atmosphere of 100 to 200° C. to effect granulation, followed by firing at a sintering temperature of from 800 to 1,400° C. for 1 to 24 hours. Thus, particles are obtained the crystal grains of which are approximately from 1 to 50 μm in size. Subsequently, the resultant sintered ferrite particles are heat-treated. By this heat treatment, many fine unevenness can be formed on the surfaces of the crystal grains constituting the ferrite particles. The heat treatment is carried out while leaving the particles in an atmosphere of an inert gas (e.g., $N_2$ gas), having an oxygen concentration of 5% or less, and preferably 2% or less, at 750 to 1,200° C., and preferably 800 to 1,150° C., for 0.5 to 3 hours, or while flowing an inert gas in a rotary kiln or the like.

The carrier in the present invention comprises a core material the particle surfaces of which are coated with a resin. The resin used for such coating may include silicone type resins, acryl-modified silicone resins, epoxy type resins, polyester type resins, styrene-acrylic type resins, melamine type resins, fluorine type resins, fluorine-acrylic type resins, and mixtures of any of these resins. In particular, it may preferably include silicone type resins, acryl-modified silicone resins, fluorine type resins and fluorine-acrylic type resins.

The acryl-modified silicone resins may include methacrylate modified silicone resins, acrylate modified silicone resins, styrene-methacrylate modified silicone resins and styrene-acrylate modified silicone resins. Any of these may be used alone or in the form of a mixture of two or more.

Stated more specifically, the silicone resins may be any conventionally known silicone resins, and may include straight silicone resins composed of only an organosiloxane linkage represented by the following formula, and silicone resins modified with alkyd, polyester, epoxy, urethane or the like.

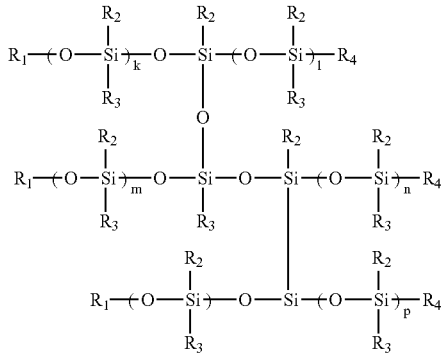

In the above formula, $R_1$ is a hydrogen atom, an alkyl group having 1 to 4 carbon atoms or a phenyl group; $R_2$ and $R_3$ each represent a hydrogen atom, an alkyl group having 1 to 4 carbon atoms, an alkoxyl group having 1 to 4 carbon atoms, a phenyl group, an alkenyl group having 2 to 4 carbon atoms, an alkenyloxy group having 2 to 4 carbon atoms, a hydroxyl group, a carboxyl group, an ethylene oxide group, a glycidyl group or a group represented by the following formula:

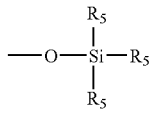

$R_4$ and $R_5$ are each a hydroxyl group, a carboxyl group, an alkyl group having 1 to 4 carbon atoms, an alkoxyl group having 1 to 4 carbon atoms, an alkenyl group having 2 to 4 carbon atoms, an alkenyloxy group having 2 to 4 carbon atoms, a phenyl group or a phenoxy group; and k, l, m, n, o and p each represent an integer of 1 or more.

The above each substituent may be unsubstituted, or may also have a substituent as exemplified by an amino group, a hydroxyl group, a carboxyl group, a mercapto group, an alkyl group, a phenyl group, an ethylene oxide group or a halogen atom. For example, as commercially available products, the straight silicone resins include KR271, KR255 and KR152, available from Shin-Etsu Chemical Co., Ltd; and SR2400 and SR2405, available from Dow Corning Toray Silicone Co., Ltd. The modified silicone resins include KR206 (alkyd modified), KR5208 (acryl-modified), ES1001N (epoxy modified) and KR305 (urethane modified), available from Shin-Etsu Chemical Co., Ltd; and SR2115 (epoxy modified) and SR2110 (alkyd modified), available from Dow Corning Toray Silicone Co., Ltd.

In the present invention, the carrier coating resin may be incorporated with a coupling agent. As the coupling agent that may be used, a silane coupling agent may be used. Besides, it may also include a titanium coupling agent and an aluminum coupling agent. A silane coupling agent preferably usable in the present invention may include, e.g., γ-(2-aminoethyl)aminopropyltrimethoxysilane, γ-(2-aminoethyl)aminopropyldimethoxysilane, γ-methacryloxypropyltrimethoxysilane, N-β-(N-vinylbenzylaminoethyl)-γ-aminopropyltrimethoxy silane hydrochloride, γ-glycidoxypropyltrimethoxysilane, γ-mercaptopropyltrimethoxysilane, methyltrimethoxysilane, methyltriethoxysilane, vinyltriacetoxysilane, γ-chloropropyltrimethoxysilane, hexamethyldisilazane, γ-anilinopropyltrimethoxysilane, vinyltrimethoxysilane, octadecyldimethyl[3-(trimethoxysilyl)propyl]ammonium chloride, γ-chloropropylmethyldimethoxysilane, methyltrichlorosilane, dimethyldichlorosilane and trimethylchlorosilane (all available from Toray Silicone Co., Ltd.); and allyltriethoxysilane, 3-aminopropylmethyldiethoxysilane, 3-aminopropyltrimethoxysilane, dimethyldiethoxysilane, 1,3-divinyltetramethyldisilazane, and methacryloxyethyldimethyl(3-trimethoxysilylpropyl) ammonium chloride (all available from Chisso Corporation).

The carrier cores may preferably be coated with the above resin in a coverage of from 0.5 to 5.0% by weight. If the coverage is less than 0.5% by weight, where a core material having surface unevenness is used, the core material tends to come bare through the resin coat layer, and this may adversely affect developing performance. If it is more than 5.0% by weight, a high electrical resistance tends to result as that for the developer, and this may trigger poor images, e.g., may cause poor gradation or edge effect. The coverage may more preferably be from 0.8 to 4.0% by weight, and still more preferably be from 1.0 to 3.0% by weight.

The carrier of the present invention is also characterized in that the coat layers each contain particles, and the particles have a number-average primary particle diameter of from 10 to 500 nm. When the cores are coated with the resin, such particles bring the effect of filling out the dales of the microscopic unevenness present on the carrier particle surfaces to smoothen the carrier particle surfaces. This enables the toner to be more effectively charged and also enables the carrier to maintain its durability. The present inventors have further found out that such particles also bring the effect of lessening difference of charge quantity (triboelectricity) in environment.

Conventionally, a ferrite carrier containing light-element oxides in a large quantity has had a disadvantage that they have a large difference of charge quantity in environment (difference of triboelectricity in environment). In the reaction to form the ferrite, first the reaction of each light-element oxide, then the reaction between the light-element oxides, the reaction of the light-element oxides with $Fe_2O_3$ and finally the reaction between all the elements lead to the formation of a ferrite having more uniform spinel structure. This is because the number of contact points of metal oxides depends on their weight. Accordingly, in the ferrite carrier containing light-element oxides in a large quantity, their weight ratio differs extremely from $Fe_2O_3$, and hence the reaction between the light-element oxides proceeds rapidly. The present inventors consider that this is due to the fact that such light-element oxide components are present in the dales of unevenness in a relatively large quantity. Such dale portions do not contribute to the lessening of the environmental difference because, if carrier cores are merely coated with a resin, it follows only that the whole carrier core surfaces are uniformly coated. As in the present invention, the cores are so coated that the dale portions are filled out by the particles, and this has made it possible to lessen the environmental difference.

If such particles have a number-average primary particle diameter of less than 10 nm, the effect of smoothening the carrier particle surfaces is not obtainable. If on the other hand the particles have a number-average primary particle diameter of more than 500 nm, the particles are larger than the size of the dales of unevenness of the carrier particle surfaces, so that the particles may come released from the carrier to make its charge-providing ability poor. As preferable number-average primary particle diameter, it may be from 25 to 400 nm, and more preferably from 50 to 300 nm.

The particles may be added in an amount of from 1 to 40% by weight, and more preferably from 5 to 30% by weight, based on the coat coverage. If they are added in an amount of less than 1% by weight, the effect of smoothening the carrier particle surfaces is not obtainable. If on the other hand they are added in an amount of more than 40% by weight, the carrier may have so excessively small a charge-providing ability as to cause fog.

As the particles to be added, usable are fine resin particles, carbon black, fine silicon oxide particles, fine titanium oxide particles and fine alumina particles.

Resin used in the fine resin particles may include polymers obtained by homopolymerization or copolymerization carried out using any of polymerizable monomers exemplified below. Such polymerizable monomers may include styrene monomers such as styrene, o-methylstyrene, m-methylstyrene, p-methoxylstyrene, p-ethylstyrene, α-methylstyrene and p-tertiary-butylstyrene; acrylic acid, and acrylates such as methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl-acrylate and phenyl acrylate; methacrylic acid, and methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminomethyl methacrylate and diethylaminomethyl methacrylate; 2-hydroxyethyl acrylate and 2-hydroxyethyl methacrylate; and besides acrylonitrile, methacrylonitrile and acrylamide; as well as vinyl derivatives specifically as exemplified by alkyl vinyl ethers such as methyl vinyl ether, ethyl vinyl ether, propyl vinyl ether, n-butyl vinyl ether and isobutyl vinyl ether, and β-chloroethyl vinyl ether, phenyl vinyl ether, p-methylphenyl vinyl ether, p-chlorophenyl vinyl ether, p-bromophenyl vinyl ether, p-nitrophenyl vinyl ether p-methoxyphenyl vinyl ether, 2-vinylpyridine, 3-vinylpyridine, 4-vinylpyridine, N-vinylpyrrolidone, 2-vinylimidazole, N-methyl-2-vinylimidazole, N -vinylimidazole and butadiene. In particular, fine polymethyl methacrylate (PMMA) resin particles and fine melamine resin particles are more preferred. As the fine PMMA resin particles, known particles may by used, and any materials necessary for toners for intended electrophotographic development may be selected. It is preferable to use cross-linked PMMA resin particles as a cross-linked organic material. Also, such fine particles may be used in combination of two or more types, and may be those having been surface-treated.

The cross-linked organic material herein termed refers to a material the molecular chain of which has a three-dimensional network structure. What is more preferred is a material having a decomposition temperature of 230° C. or more, and preferably 260° C. or more, to obtain good results.

As methods for granulating the fine resin particles used in the present invention, usable are a method in which the above polymer is pulverized, and particle polymerization such as soap-free polymerization, suspension polymerization and dispersion polymerization. Such fine particles may be used in combination of two or more types, and may be those having been surface-treated.

As a coating method by which the resin coat layers are formed on the carrier core surfaces, it is common to dilute the resin with a solvent and coat the carrier core surfaces with the dilute solution obtained. The solvent used here may be any of those soluble in the resins. In the case of resins soluble in an organic solvent, the organic solvent may include toluene, xylene, Cellosolve, butyl acetate, methyl ethyl ketone, methyl isobutyl ketone, and methanol. In the case of water-soluble resins or those of an emulsion type, water may be used.

As a method by which the carrier core surfaces are coated with the resin diluted with the solvent, the carrier cores may be coated by any of coating methods such as dip coating, spray coating, brush coating and kneading, and thereafter the solvent is evaporated off. Incidentally, not such a wet process making use of the solvent, it is also possible to cover the carrier core materials with resin powder by a dry process.

Where the carrier core surfaces are coated with the resin and thereafter the coatings formed are baked, any of an external heating method and an internal heating method may be used. For example, a stationary or fluidizing electric furnace, a rotary electric furnace or a burner furnace may be used, or baking by microwaves may also be carried out. Baking temperature may differ depending on the resin used, and must be temperature of not lower than its melting point or glass transition point. Also, in the case of a heat-curable resin or a condensation type resin, the temperature must be raised to the temperature at which its curing proceeds sufficiently.

The carrier core surfaces are thus coated with the resin and the resin coatings are baked, followed by cooling, disintegration and particle size adjustment, through which a resin-coated carrier can be obtained.

The fine resin particles may be present on the carrier particle surfaces. As a method for their incorporation, it is preferable that, when coated with the resin, they are dispersed in the solvent, to make them dispersed on the carrier core surfaces so as to be present together with the carrier coating resin. Here, as the solvent in which they are to be dispersed, it is preferable to select one in which the fine resin particles do not swell.

The carrier obtained after such coating may preferably finally be brought to mechanical removal of surface unevenness. It is to apply a mechanical stress to the carrier to make carrier particles collide against one another or make them collide against an agitation member so that the carrier particle surfaces can be treated by any of compression, shearing, impact and friction or by combination of any of these. This enhances the particle surface smoothness of the carrier and makes greater the effect to be brought by the present invention. There are no particular limitations on the means for such mechanical treatment, which may specifically include mixing machines such as Turbla mixer, a cone blender, a ball mill, a vibration ball mill, a sand mill, a pulverizer, an attritor, Henschel mixer and Nauta mixer. In particular, it is preferable to mechanically treat the carrier by means of Nauta mixer.

As a binder resin of the toner to be combined with the carrier of the present invention as described above, it may include polyester and polystyrene; polymeric compounds obtained from styrene derivatives such as poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl $\alpha$-chloromethacrylate copolymer, a styrene-acrylonitrile copolymer, a styrene-methyl vinyl ketone copolymer, a styrene-butadiene copolymer, a styrene-isoprene copolymer and a styrene-acrylonitrile-indene copolymer; polyvinyl chloride, phenolic resins, modified phenolic resins, maleic resins, acrylic resins, methacrylic resins, polyvinyl acetate, and silicone resins; polyester resins having as a structural unit a monomer selected from aliphatic polyhydric alcohols, aliphatic dicarboxylic acids, aromatic dicarboxylic acids, aromatic dialcohols and diphenols; and polyurethane resins, polyamide resins, polyvinyl butyral, terpene resins, cumarone indene resins, and petroleum resins.

A toner having core/shell structure the core of which is formed of a low-softening substance by encapsulating the low-softening substance into toner particles may also preferably be used. Such a toner makes use of a low-softening substance, and hence the toner has been made advantageous for low-temperature fixing but tends to be disadvantageous for heat generation due to mechanical shearing, so that it may cause toner-spent inside a developing assembly. However, the use of the carrier of the present invention eliminates such a possibility.

As a specific method by which the low-softening substance is encapsulated into toner particles, a low-softening substance whose material polarity in an aqueous medium is set smaller than the chief monomer may be used and also a small amount of resin or monomer with a greater polarity may be added. Thus, the toner particles having what is called core/shell structure can be obtained, in which the low-softening substance is covered with a shell resin.

The particle size distribution and particle diameter of the toner particles may be controlled by a method in which the types and amounts of slightly water soluble inorganic salts or dispersants having the action of protective colloids are changed, or by controlling mechanical apparatus conditions as exemplified by stirring conditions such as rotor peripheral speed, pass times and stirring blade shapes, and the shape of vessels or the solid matter concentration in aqueous mediums, whereby the intended toner can be obtained.

The shell resin of such a toner may include styrene-acrylic or -methacrylic copolymers, polyester resins, epoxy resins, and styrene-butadiene copolymers.

When the toner particles are directly obtained by polymerization, monomers for them may preferably be used. Stated specifically, preferably usable are styrene; styrene monomers such as o-, m- or p-methylstyrene and m- or p-ethylstyrene; acrylate or methacrylate monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile, and acrylic acid amide.

In such a toner, at least one of fine silica particles and fine titanium oxide particles may be used as an external additive. This is preferable because the developer can well be endowed with fluidity and the developer can be improved in service life. Use of such fine particles also brings a developer that may undergo less environmental variations.

Other external additives may preferably include fine metal oxide powder (such as aluminum oxide, strontium titanate, cerium oxide, magnesium oxide, chromium oxide, tin oxide and zinc oxide powders), fine nitride powder (such as silicon nitride powder), fine carbide powder (such as silicon carbide powder), fine metal salt powder (such as calcium sulfate, barium sulfate and calcium carbonate powders), fine fatty acid metal salt powder (such as zinc stearate and calcium stearate powders), carbon black, fine resin powder (such as polytetrafluoroethylene, polyvinylidene fluoride, polymethyl methacrylate, polystyrene and silicone resin powders). Any of these external additives may be used alone or in combination of two or more. The above external additives, inclusive of silica fine powder, may more preferably be those having been subjected to hydrophobic treatment.

The external additive described above may preferably have a number-average particle diameter of 0.2 μm or smaller. If it has a number-average particle diameter of more than 0.2 μm, the toner may have a low fluidity to bring about a low image quality at the time of development and transfer.

The external additive may preferably be used in an amount of from 0.01 to 10 parts by weight, and more preferably from 0.05 to 5 parts by weight, based on 100 parts by weight of toner particles.

The external additive may preferably be those having a specific surface area of 30 $m^2/g$ or larger, and more preferably from 50 to 400 $m^2/g$, as measured using nitrogen adsorption by the BET method.

The treatment to mix the toner particles and the external additive may be made by means of a mixing machine such as Henschel mixer.

In the present invention, the colorant used in the toner may include the following.

As yellow colorants, compounds as typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147 and 168 may preferably be used.

As magenta colorants, condensation azo compounds, diketopyroropyyrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 may preferably be used.

As cyan colorants, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may preferably be used.

Any of these colorants may be used alone, in the form of a mixture, or in the state of a solid solution.

As a black colorant, it may include carbon black, and colorants toned in black by the use of the yellow, magenta and cyan colorants shown above. Also, as uses for full color, only a black toner may make use of a magnetic toner so that a magnetic one-component developer can be used.

The colorants are, in the case of color toners, selected taking account of hue angle, chroma, brightness, weatherability, transparency on OHP films and dispersibility in toner particles. The colorant may be contained in an amount of from 1 to 20 parts by weight based on 100 parts by weight of the binder resin for toner.

As a charge control agent used in the toner, known agents may be used. In the case of color toners, it is particularly preferable to use charge control agents that are colorless or light-colored, make toner charging speed higher and are capable of stably maintaining a constant charge quantity. In the present invention, in the case when polymerization methods are used to obtain the toner particles, charge control agents having neither polymerization inhibitory action nor solubilizates in the aqueous medium are particularly preferred.

As negative charge control agents, preferably usable are, e.g., metal compounds of salicylic acid, dialkylsalicylic acid, naphthoic acid, dicarboxylic acids or derivatives of these, polymer type compounds having sulfonic acid or carboxylic acid in the side chain, boron compounds, urea compounds, silicon compounds, and carixarene. As positive charge control agents, preferably usable are, e.g., quaternary ammonium salts, polymer type compounds having such a quaternary ammonium salt in the side chain, guanidine compounds, and imidazole compounds. The charge control agent may preferably be used in an amount of from 0.5 to 10 parts by weight based on 100 parts by weight of the binder resin. However, the addition of the charge control agent to the toner particles is not essential.

As methods for producing the toner particles, they may include a method in which the binder resin, the colorant and other internal additives are melt-kneaded and the kneaded product obtained is cooled, followed by pulverization and classification; a method in which toner particles are directly produced by suspension polymerization; a dispersion polymerization method in which toner particles are directly produced using an aqueous organic solvent in which monomers are soluble and polymers obtained are insoluble; and a method in which toner particles are produced by emulsion polymerization, as typified by soap-free polymerization in which toner particles are formed by direct polymerization in the presence of a water-soluble polar polymerization initiator.

In the present invention, the method of producing toner particles by suspension polymerization is preferred, by which fine-particle toners having a sharp particle size distribution and a weight-average particle diameter of from 3 to 10 μm can be obtained relatively with ease.

When the polymerization is used to produce the toner particles, the polymerization initiator may include, e.g., azo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide and lauroyl peroxide; any of which may be used.

The polymerization initiator may commonly be used in an amount of from 0.5 to 20% by weight based on the weight of the polymerizable monomer, which varies depending on the intended degree of polymerization. The polymerization initiator may a little vary in type depending on the methods for polymerization, and may be used alone or in the form of a mixture, making reference to its 10-hour half-life period temperature. In order to control the degree of polymerization, any known cross-linking agent, chain transfer agent and polymerization inhibitor may further be added.

In the case when suspension polymerization is used as a toner production process, a dispersant may be used, including, e.g., as inorganic oxides, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic compounds, it may include polyvinyl alcohol, gelatin, methyl cellulose, methyl hydroxypropyl cellulose, ethyl cellulose, carboxymethyl cellulose sodium salt, and starch. These are dispersed in an aqueous phase when used. Any of these dispersants may preferably be used in an amount of from 0.2 to 10.0 parts by weight based on 100 parts by weight of the polymerizable monomer.

As these dispersants, those commercially available may be used as they are. In order to obtain dispersed particles having a fine and uniform particle size, however, the inorganic compound may be formed in a dispersion medium under high-speed agitation. For example, in the case of tricalcium phosphate, an aqueous sodium phosphate solution and an aqueous calcium chloride solution may be mixed under high-speed agitation, whereby a dispersant preferable for the suspension polymerization can be obtained. Also, in order to make the particles of these dispersants finer, 0.001 to 0.1% by weight of a surface active agent may be used in combination. Stated specifically, commercially available nonionic, anionic or cationic surface active agents may be used. For example, preferably usable are sodium dodecyl sulfate, sodium tetradecyl sulfate, sodium pentadecyl sulfate, sodium octyl sulfate, sodium oleate, sodium laurate, potassium stearate and calcium oleate.

When direct polymerization is employed in the toner production process, the toner can be produced specifically by a production process as described below. A monomer composition prepared by adding to a polymerizable monomer a low-softening substance release agent, a colorant, a charge control agent, a polymerization initiator and other additives, and uniformly dissolving or dispersing them by means of a homogenizer or an ultrasonic dispersion machine, is dispersed in an aqueous medium containing a dispersion stabilizer, by means of a conventional stirrer or a homomixer or a homogenizer. Granulation is carried out preferably while controlling the stirring speed and time so that droplets formed of the monomer composition can have the desired toner particle size. After the granulation, stirring may be carried out to such an extent that the state of particles is maintained and the particles can be prevented from settling, by the action of the dispersion stabilizer. The polymerization may be carried out at a polymerization temperature set at 40° C. or above, usually from 50 to 90° C. At the latter half of the polymerization, the temperature may be raised, and also the aqueous medium may be removed in part at the latter half of the reaction or after the reaction has been completed, in order to remove unreacted polymerizable monomers and by-products. After the reaction has been completed, the toner particles formed are collected by washing and filtration, followed by drying. In the suspension polymerization, water may preferably be used as the dispersion medium usually in an amount of from 300 to 3,000 parts by weight based on 100 parts by weight of the monomer composition.

The toner thus obtained may be classified to control its particle size distribution. As a method therefor, a multi-division classifier that utilizes inertia force may preferably be used. Use of such a classifier enables efficient production of toners having particle size distribution preferable in the present invention.

In the present invention, as preferable particle shape of the toner, the toner may have, in its particles of 3 μm or more in circle-equivalent diameter, an average circularity of from 0.930 to 0.985, and more preferably from 0.940 to 0.980.

In the present invention, when the toner and the carrier are blended to prepare a two-component type developer, they may preferably be blended in such a proportion that the toner in the developer is in a concentration of from 2 to 20% by weight, more preferably from 2 to 15% by weight, and still more preferably from 4 to 13% by weight. In such toner concentration, good toner images can be obtained. If the toner is in a concentration of less than 2% by weight, image density tends to lower. If it is in a concentration more than 20% by weight, fog or in-machine scatter tends to occur and also a short service life of the developer may result.

The image forming method of the present invention is further described below in detail. The image forming method of the present invention has (I) a charging step of charging the surface of an photosensitive member electrostatically, (II) a latent-image forming step of forming an electrostatic latent image on the photosensitive member surface thus charged, (III) a developing step of feeding a toner to the electrostatic latent image by the action of an electric field formed between i) a developer having the toner, held in a developing unit, and ii) the photosensitive member to render the electrostatic latent image visible to form a toner image, (IV) a transfer step of transferring the toner image onto a transfer material via, or not via, an intermediate transfer member, and (V) a fixing step of making the transfer material pass a nip formed by a fixing member and a pressure member pressed against the fixing member, to fix the toner image to the transfer material with heating and in pressure contact.

An example of the image forming method of the present invention is described below with reference to the accompanying drawings.

FIG. 1 is a partial diagrammatic view showing an example of an image forming apparatus employing the image forming method of the present invention. Its details are described later. This image forming apparatus has a photosensitive drum 1 as a photosensitive member on which electrostatic latent images are to be held, a charging means 2 which charges the surface of the photosensitive drum 1 electrostatically, an information writing means (not shown) which forms the electrostatic latent images on the surface of the photosensitive drum 1, a developing assembly 4 by means of which the electrostatic latent images formed on the surface of the photosensitive drum 1 are developed and rendered visible by the use of the toner to form toner images, and a transfer blade 27 as a transfer means which transfers to a transfer material 25 the toner images formed by means of the developing assembly 4.

As a development method making use of the toner in the present invention, the development may be performed using, e.g., a developing means as shown in FIG. 1. In the present invention, the step of development may preferably be the step of applying a vibrating electric field formed by superimposing an AC component on a DC component. Stated specifically, the development may preferably be performed applying an alternating electric field and in such a state that a magnetic brush is kept in touch with the latent image bearing member photosensitive member, e.g., the photosensitive drum 1.

A distance B between a developer carrying member (developing sleeve) 11 and the photosensitive drum 1 (S-D distance) may preferably be from 100 to 800 μm. This is favorable for preventing carrier adhesion and improving dot reproducibility. If the B is smaller than 100 μm, the developer tends to be insufficiently fed to the photosensitive member, resulting in a low image density. If it is larger than 800 μm, the magnetic line of force from a magnet pole S1 may broaden to make the magnetic brush have a low density, resulting in a poor dot reproducibility, or to weaken the force of binding the magnetic coat carrier, tending to cause carrier adhesion.

The alternating electric field may preferably be applied at a peak-to-peak voltage of from 300 to 3,000 V and a frequency of from 500 to 10,000 Hz, and preferably from 1,000 to 7,000 Hz, which may each be applied under appropriate selection in accordance with processes. In this instance, the waveform used may be selected in variety from a triangular waveform, a rectangular waveform, a sinusoidal waveform, a waveform with varied duty ratio, an intermittent alternating superimposed electric field and so forth. If the applied voltage is lower than 300 V, a sufficient image density can be attained with difficulty, and fog toner at non-image areas can not be well collected in some cases. If it is higher than 5,000 V, the latent image may be disordered through the magnetic brush to cause a lowering of image quality.

If the frequency is lower than 500 Hz, being concerned with process speed, the toner having come into contact with the photosensitive member can not be well vibrated when returned to the developing sleeve, so that fog tends to occur. If it is higher than 10,000 Hz, the toner can not follow up the electric field to tend to cause a lowering of image quality.

Use of a two-component developer having a toner well charged enables application of a low fog take-off voltage (Vback), and enables the photosensitive member to be low charged in its primary charging, thus the photosensitive member can be made to have a longer lifetime. The Vback, which may depend on the developing system, may preferably be 350 V or less, and more preferably 300 V or less.

As contrast. potential, a potential of from 100 V to 500 V may preferably be used so that a sufficient image density can be achieved.

What is important in the developing method in the present invention is as follows: In order to perform development promising a sufficient image density, achieving a superior dot reproducibility and free of carrier adhesion, the magnetic brush on the developing sleeve 11 may preferably be made to come into touch with the photosensitive drum 1 at a width (developing nip C) of from 3 to 8 mm. If the developing nip C is narrower than 3 mm, it may be difficult to well satisfy sufficient image density and dot reproducibility. If it is broader than 8 mm, the developer may pack into the nip to cause the machine to stop from operating, or it may be difficult to well prevent the carrier adhesion. As methods for adjusting the developing nip, the nip width may appropriately be adjusted by adjusting the distance A between a developer control blade 15 and the developing sleeve 11, or by adjusting the distance B between the developing sleeve 11 and the photosensitive drum 1.

The image forming method of the present invention enables development that is faithful to dot latent images because it is not affected by the injection of electric charges through the toner and does not disorder latent images when, in the reproduction of images attaching importance especially to halftones, the developer and developing method of the present invention are used especially in combination with a developing system where digital latent images are formed. In the step of transfer as well, the use of the toner having been fine-powder cut-off and having a sharp particle size distribution enables achievement of a high transfer efficiency and hence enables achievement of a high image quality at both halftone areas and solid areas.

Concurrently with the achievement of a high image quality at the initial stage, the use of the above two-component type developer makes the toner have less change in charge quantity inside the developing assembly, and can well bring out the effect of the present invention that no decrease in image density may occur even when copied on a large number of sheets.

Preferably, the image forming apparatus may have developing assemblies for magenta, cyan, yellow and black and development for black may finally be made, whereby images can more assume a tightness (tighter images).

The image forming method of the present invention is further described below with reference to FIG. 1.

In the image forming apparatus shown in FIG. 1, a magnetic brush composed of magnetic particles 23 is formed on the surface of a transport sleeve 22 by the action of a magnetic force a magnet roller 21 has. This magnetic brush is brought into touch with the surface of a photosensitive drum 1 to charge the photosensitive drum 1 electrostatically. A charging bias is kept applied to the transport sleeve 22 by a bias applying means (not shown).

The photosensitive drum 1 thus charged is exposed to laser light 24 by means of an exposure unit as a latent-image forming means (not shown) to form a digital electrostatic latent image. The electrostatic latent image thus formed on the photosensitive drum 1 is developed with a toner 19*a* held in a developer 19 carried on a developing sleeve 11 internally provided with a magnet roller 12 and to which a development bias is kept applied by a bias-applying means (not shown).

The inside of a developing assembly 4 is partitioned into a developer chamber R1 and an agitator chamber R2 by a partition wall 17, and is provided with developer transport screws 13 and 14, respectively. At the upper part of the agitator chamber R2, a developer storage chamber R3 holding a replenishing developer 18 therein is installed. At the lower part of the developer storage chamber R3, a supply opening 20 is provided.

As a developer transport screw 13 is rotatingly driven, the developer held in the developer chamber R1 is transported in one direction in the longitudinal direction of the developing sleeve 11 while being agitated. The partition wall 17 is provided with openings (not shown) on this side and the inner side as viewed in the drawing. The developer transported to one side of the developer chamber R1 by the screw 13 is sent into the agitator chamber R2 through the opening on the same side of the partition wall 17, and is delivered to the developer transport screw 14. The screw 14 is rotated in the direction opposite to the screw 13. Thus, while the developer in the agitator chamber R2, the developer delivered from the developer chamber R1 and the toner replenished from the developer storage chamber R3 are agitated and blended, the developer is transported inside the agitator chamber R2 in the direction opposite to the screw 13 and is sent into the developer chamber R1 through the opening on the other side of the partition wall 17.

To develop the electrostatic latent image formed on the photosensitive drum 1, the developer 19 held in the developer chamber R1 is drawn up by the action of the magnetic force of the magnet roller 12, and is carried on the surface of the developing sleeve 11. The developer carried on the developing sleeve 11 is transported to the developer control blade 15 as the developing sleeve 11 is rotated, where the developer is controlled into a developer thin layer with a proper layer thickness. Thereafter, it reaches a developing zone where the developing sleeve 11 faces the photosensitive drum 1. In the magnet roller 12 at its part corresponding to the developing zone, a magnetic pole (development pole) N1 is positioned, and the development pole N1 forms a magnetic field at the developing zone. This magnetic field causes the developer to rise in ears, thus the magnetic brush of the developer is formed in the developing zone. Then, the magnetic brush comes into touch with the photosensitive drum 1. The toner attracted to the magnetic brush and the toner attracted to the surface of the developing sleeve 11 are moved to and become attracted to the region of the electrostatic latent image on the photosensitive drum 1, where the electrostatic latent image is developed, thus a toner image is formed.

The developer having-passed through the developing zone is returned into the developing assembly 4 as the developing sleeve 11 is rotated, then stripped off the developing sleeve 11 by a repulsive magnetic field formed between magnetic poles S1 and S2, and dropped into the developer chamber R1 and agitator chamber R2 so as to be collected there.

Once a T/C ratio (blend ratio of toner and carrier, i.e., toner concentration in the developer) of the developer in the developing assembly 4 has lowered as a result of the above development, the replenishing developer 18 is replenished from the developer storage chamber R3 to the agitator chamber R2 in the quantity corresponding to the quantity of the toner consumed by the development, thus the T/C ratio of the developer 19 is maintained to a stated quantity. To detect the T/C ratio of the developer 19 in the developing assembly 4, a toner concentration detecting sensor 28 is used which measures changes in permeability of the developer by utilizing the inductance of a coil. The toner concentration detecting sensor 28 has a coil (not shown) on its inside.

The developer control blade 15, which is provided beneath the developing sleeve 11 to control the layer thickness of the developer 19 on the developing sleeve 11, is a non-magnetic blade made of a non-magnetic material such as aluminum or SUS316 stainless steel. The distance between its end and the surface of the developing sleeve 11 is from 150 to 1,000 μm, and preferably from 250 to 900 μm. If this distance is smaller than 150 μm, the magnetic carrier 19*b* may be caught between them to tend to make the developing layer non-uniform, and also the developer necessary for performing good development may be coated on the sleeve with difficulty, so that developed images with a low density and much non-uniformity tend to be formed. In order to prevent non-uniform coating (what is called blade clog) due to unauthorized particles included in the developer, the distance may preferably be 250 μm or more. If it is more than 1,000 μm, the quantity of the developer coated on the developing sleeve 11 increases to make it difficult to make desired control of the developer layer thickness, so that the magnetic carrier particles adhere to the photosensitive drum 1 in a large quantity and also the circulation of the developer and the control of the developer by the developer control blade 15 may become less effective to tend to cause fog because of a decrease in triboelectricity of the toner.

The toner image formed by development is transferred onto a transfer material (recording material) 25 transported to a transfer zone, by means of a transfer blade 27 which is a transfer means to which a transfer bias is kept applied by a bias-applying means 26. The toner image thus transferred onto the transfer material is fixed to the transfer material by means of a fixing assembly (not shown). Transfer residual toner remaining on the photosensitive drum 1 without being transferred to the transfer material in the transfer step is charge-controlled in the charging step and collected at the time of development.

Figure 2:
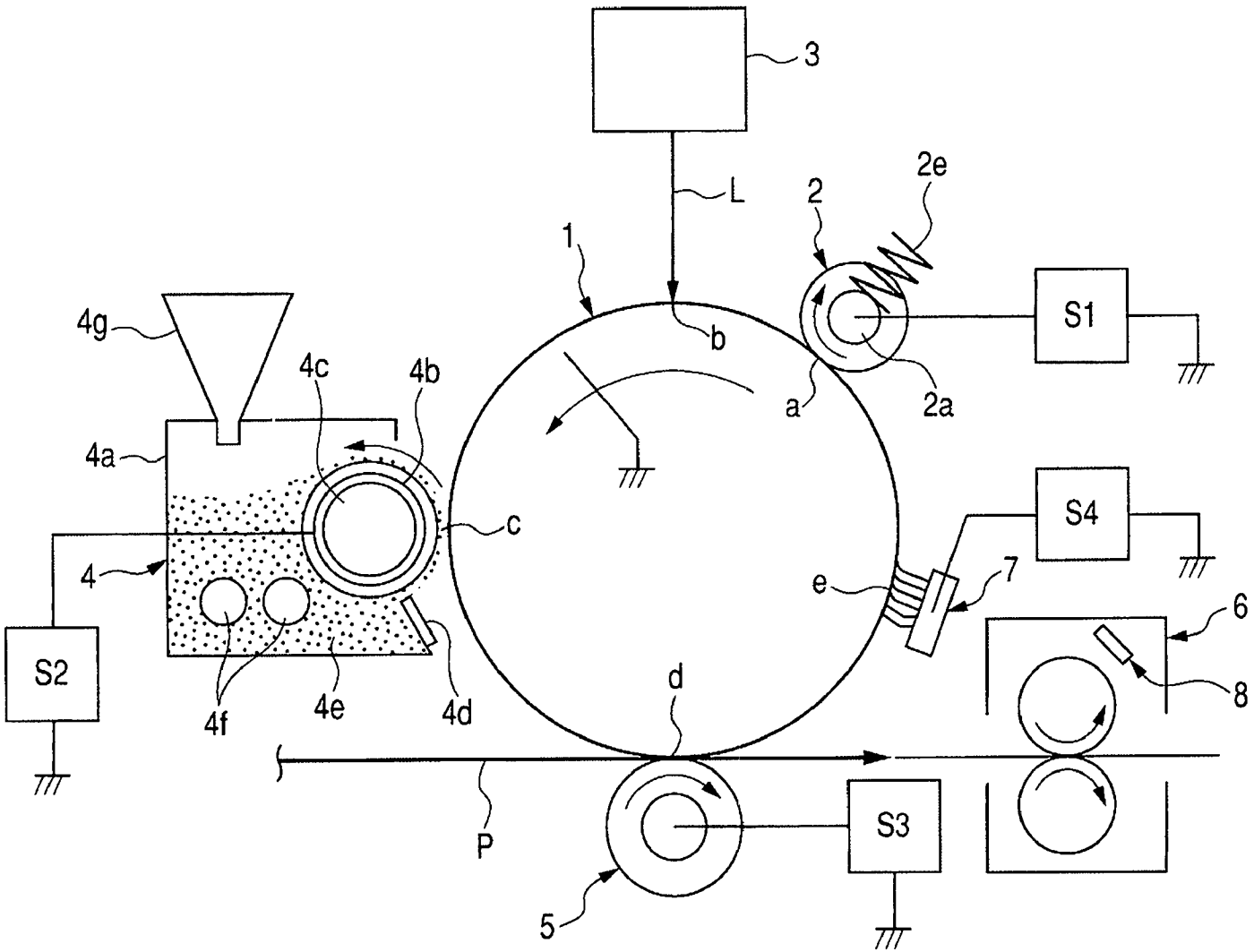
FIG. 2 is a schematic illustration showing another example of an image forming apparatus in which the image forming method of the present invention is preferably used.

The image forming method of the present invention may also preferably be a method further having a charge quantity control step in which the transfer residual toner having remained on the photosensitive member surface after the transfer step is charged to a regular polarity, the charging step is carried out after this charge quantity control step has been carried out, and the transfer residual toner is collected in the developing step. FIG. 2 is a schematic sectional view showing an example of an image forming apparatus in which the image forming method having such a charge quantity control step is preferably used. The image forming method further having the charge quantity control step is described below with reference to FIG. 2.

An image forming apparatus employing this embodiment has a photosensitive drum 1 as a photosensitive member, a charging roller 2 as a charging member which charges the surface of this photosensitive drum 1 electrostatically, a laser system 3 as an information writing means which forms an electrostatic latent image on the photosensitive drum 1, a developing assembly 4 by means of which the electrostatic latent image formed on the photosensitive drum 1 surface is rendered visible by the use of a toner to form a toner image, a transfer roller 5 as a transfer means by which the toner image formed by the developing assembly 4 is transferred to a transfer material p, a fixing means 6 by which the toner image transferred to the transfer material p is fixed onto the transfer material, and a charge quantity control member 7 which charges to a regular polarity the transfer residual toner having remained on the photosensitive member surface after the toner image has been transferred to the transfer material P.

As shown in FIG. 2, a sated charging bias voltage is applied to the charging roller 2 from a power source S1 to charge the photosensitive drum 1 electrostatically. Here, the charging bias voltage may be a vibrating voltage formed by superimposing an AC voltage (Vac) on a DC voltage (Vdc). Thereafter, imagewise exposure is effected by the laser system 3 to form an electrostatic latent image.

The electrostatic latent image formed on the photosensitive drum 1 is developed by the developing assembly 4 to come into a toner image. In the developing assembly 4, a developing sleeve 4*b* is provided in proximity and face to face to the surface of the photosensitive drum 1 on which the electrostatic latent image has been formed. The part where the photosensitive drum 1 and the developing sleeve 4*b* face to each other is a developing zone c. The developing sleeve 4*b* may preferably be rotatingly driven in the direction opposite to the direction of movement of the photosensitive drum 1 at the developing zone c. The developing sleeve 4*b* is internally provided with a magnet roller 4*c*. By the action of a magnetic force of this magnet roller 4*c*, part of a two-component developer 4*e* held in a developer container 4*a* is attracted and held as a magnetic-brush layer, on the periphery of this developing sleeve 4*b*. The two-component developer 4*e* attracted and held on the developing sleeve 4*b* is rotatingly transported as the sleeve 4*b* is rotated, and is layer-controlled to a stated thin layer by a developer-coating blade 4*d*, where its thin layer comes into touch with the surface of the photosensitive drum 1 at the developing zone c to rub the photosensitive drum surface appropriately.

To the developing sleeve 4*b*, a stated development bias voltage is applied from a power source S2 in this embodiment, the development bias voltage applied to the developing sleeve 4*b* is the vibrating voltage formed by superimposing an AC voltage (Vac) on a DC voltage (Vdc); Thus, the electrostatic latent image formed on the photosensitive drum 1 is developed with the toner contained in the two-component developer 4*e*, so that a toner image is formed. The toner image thus formed is transferred to a transfer material P (or an intermediate transfer member) at a transfer zone d by the aid of a transfer roller 5. The toner having remained on the photosensitive drum 1 surface (transfer residual toner) undergoes the following step of charge quantity control.

To the charge quantity control member 7 provided in contact with the photosensitive drum 1, a stated voltage is applied from a power source S4. The transfer residual toner on the photosensitive drum 1 comes into contact with a brush at a brush contact zone e, which is a contact zone between the charge quantity control member 7 and the photosensitive drum 1, so that this toner is controlled to a regular polarity. In the case of a negatively chargeable toner, a negative voltage is applied to the photosensitive drum 1. In the case of a positively chargeable toner, a positive voltage is applied to the photosensitive drum 1. Undergoing such a step, in the case of the cleanerless system, the transfer residual toner can well be collected at the time of development. Not shown in FIG. 2, it is also an effective means that, in order to remove residual electric charges of the photosensitive drum 1 and improve drum ghost proofness, the same member as the charge quantity control member 7 used in the charge quantity control step is used between the transfer step and the charge quantity control step to provide the photosensitive drum 1 with a potential having a polarity reverse to the one applied in the charging step.

Incidentally, in FIG. 2, reference numeral 2*a* denotes a conductive support made of stainless steel, and 2*e* charging roller press-contact member such as a spring, 6 fixing device, 8 non-contact thermistor. The symbol a denotes charging zone, b, exposure zone. Reference numeral 4*f* denotes a developer delivery screw, 4*g* developer strage chamber, S3 power source, L, exposure light.

The image forming method of the present invention is also an image forming method comprising forming an electrostatic latent image on an electrostatic latent image bearing member, forming a magnetic brush out of a toner and a carrier on a developer carrying member internally provided with a magnetic-field generating means, and developing the electrostatic latent image by means of the magnetic brush formed on the developer carrying member, to form a toner image on the electrostatic latent image bearing member; the magnetic brush having the toner in an amount of from 2 to 20 parts by weight based on 100 parts by weight of the carrier; and the method having the step of feeding a replenishing developer to a developing assembly, and discharging out of the developing assembly the carrier that has become excess in the interior of the developing assembly.

Such a system in which the replenishing developer is fed to the developing assembly and the carrier that has become excess in the interior of the developing assembly is discharged out of the developing assembly is called an auto-carrier-refresh (ACR) system. An example of an image forming apparatus of this system is described below with reference to drawings. The use of the replenishing developer in this ACR system can sufficiently bring out the effect of the present invention such that image quality can be kept from lowering, even when the carrier is replenished in a small quantity from the replenishing developer for auto-carrier-refreshing.

Figure 4:
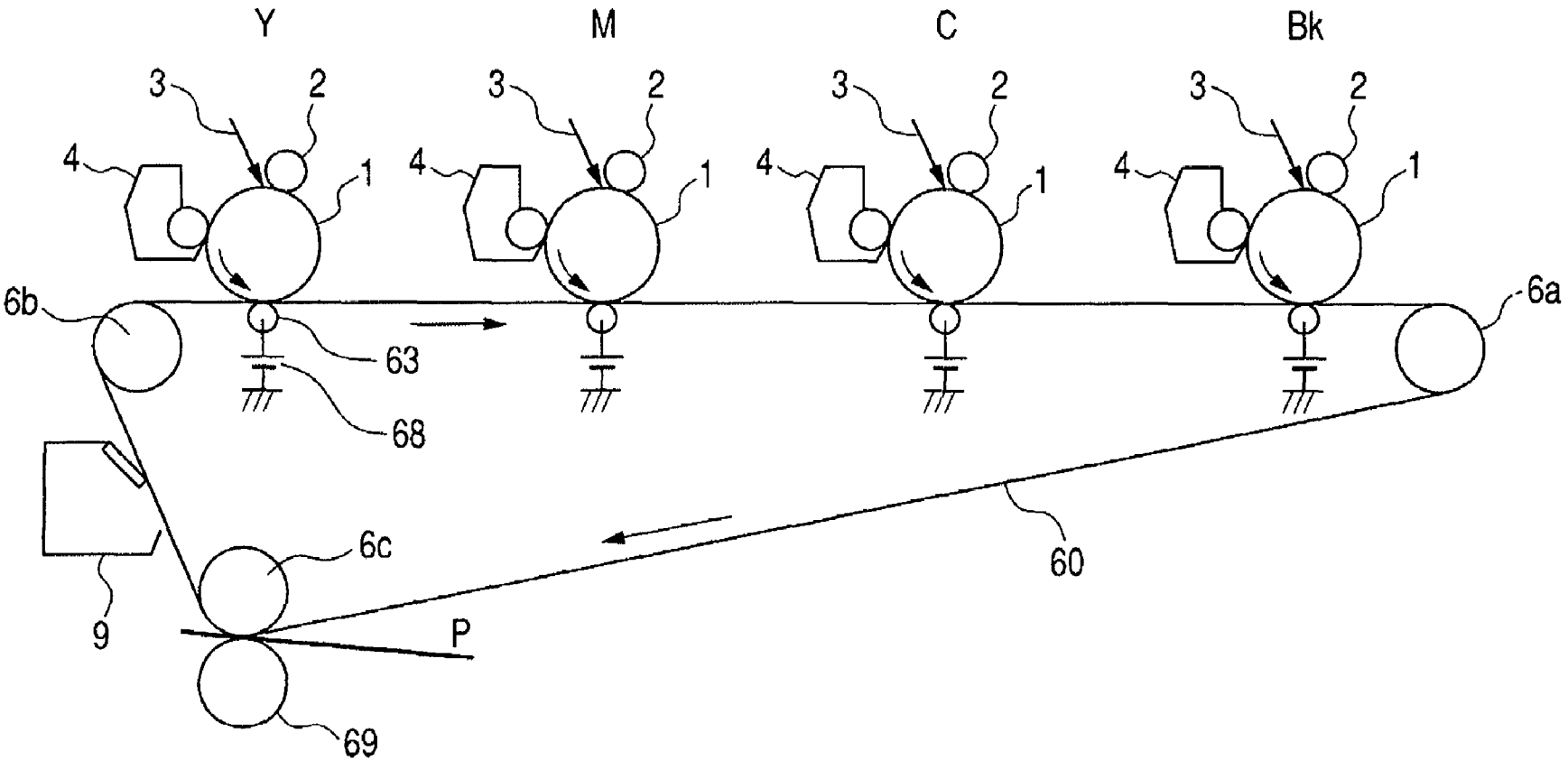
FIG. 4 is a structural view of an image forming apparatus of a tandem type.

A color laser printer shown in FIG. 4 is a four-tandem drum type (in-line) printer for obtaining full-color printed images, which has a plurality of developing assemblies and in which the toner images are first continuously superimposingly multiple-transferred to a second image bearing member intermediate transfer belt 60.

As shown in FIG. 4, an endless intermediate transfer belt 60 is stretched over a drive roller 6*a*, a tension roller 6*b* and a secondary transfer opposing roller 6*c*, and is rotated in the direction of an arrow shown in the drawing.

Four developing assemblies are arranged in series along the intermediate transfer belt 60 and correspondingly to the respective colors.

The image forming method in this printer is described below.

A photosensitive drum 1 disposed in a developing assembly which performs development with a yellow toner is, in the course of its rotation, uniformly electrostatically charged to stated polarity and potential by means of a primary charging roller 2 and then subjected to imagewise exposure 3 by an imagewise exposure means (not shown) (e.g., an optical exposure system for color separation and image formation of color original images, or a scanning exposure system by laser scanning that outputs laser beams modulated in accordance with time-sequential electrical digital pixel signals of image information), so that an electrostatic latent image is formed which corresponds to a first color component image (a yellow color component image) of an intended color image.

Next, the electrostatic latent image thus formed is developed with a first-color yellow toner by means of a first developing assembly (yellow developing assembly) 4.

In what is shown in FIG. 4, the yellow toner image formed on the photosensitive drum 1 enters a primary transfer nip between the photosensitive drum 1 and the intermediate transfer belt 60. At this transfer nip, a flexible electrode 63 is kept in contact with the back of the intermediate transfer belt 60. The flexible electrode 63 is provided in each port, and has a primary transfer bias source 68 so that bias can independently be applied for each port. The yellow toner image is first transferred to the intermediate transfer belt 60 at the first-color port. Subsequently, a magenta toner image, a cyan toner image and a black toner image which have been formed through the same steps as those described above are superimposingly multiple-transferred in sequence at the respective ports from photosensitive drums 1 corresponding to the respective colors.

The four-color full-color images formed on the intermediate transfer belt 60 are subsequently one time transferred to a transfer material P by the aid of a secondary transfer roller 68, and then melt-fixed by means of a fixing assembly (not shown) to obtain a color print image.

Secondary-transfer residual toner remaining on the intermediate transfer belt 60 is removed by blade cleaning by means of an intermediate transfer belt cleaner 9 to prepare for the next image forming step.

In selecting materials for the intermediate transfer belt 60, any elastic material is not desirable because good registration must be secured at the ports for the respective colors. It is desirable to use a resin type belt, a metal-cored rubber belt, or a resin-rubber belt.

The auto-carrier-refresh development usable in the present invention is described with reference to FIG. 5.

Figure 5:
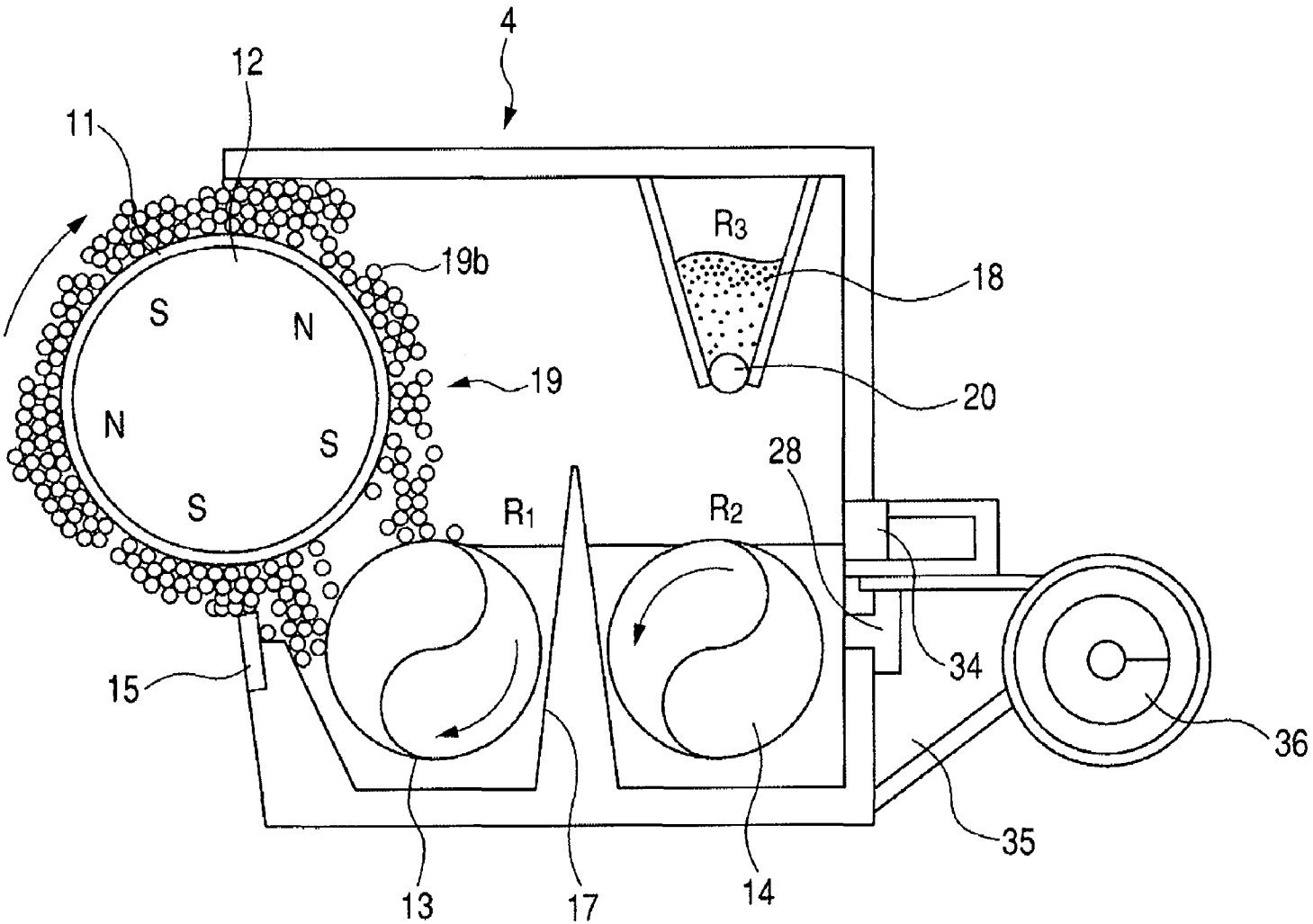
FIG. 5 is a sectional view showing an example of a developing assembly used in the tandem type apparatus.

In development operation of a developing assembly 4 shown in FIG. 5, making use of the auto-carrier-refresh developing system, the replenishing developer prepared by blending the toner and the magnetic carrier is fed from a developer holding chamber R3 to the developing assembly 4 through a replenishing opening 20.

When the development operation is repeated while feeding the replenishing developer, the carrier having come excess is overflowed from a developing assembly side developer discarding opening 34 provided in the developing assembly 4, and is discharged out of a developer intermediate collection chamber 35 through a developer collection auger 36 to a developer collection container (not shown).

EXAMPLES

The present invention is described below by giving Examples. The present invention is by no means limited to these Examples.

Incidentally, measuring methods used in Examples in the present invention are as described below.

1) Measurement of Volume Distribution Based 50% Particle Diameter (D50) of Carrier:

An SRA type microtrack particle size analyzer (manufactured by Nikkiso Co. Ltd.) is used. Measurement range is set at from 0.7 to 125 μm, and the 50% volume-average particle diameter (D50) is determined.

2) Measurement of Saturation Magnetization, Residual Magnetization and Coercive Force of Carrier:

The magnetic properties of the carrier is measured with a vibration magnetic-field type magnetic-property autographic recorder BHV-30, manufactured by Riken Denshi Co., Ltd. A cylindrical plastic container of about 0.07 $cm^3$ in volume is filled with the carrier in the state it has well densely been packed. In this state, the magnetic moment is measured, and the actual weight when the sample (carrier) is put in is measured to determine on the basis thereof the intensity of magnetization per unit volume. In the measurement, an applied magnetic field is little by little added, and is changed until it reaches 240 KA/m. Then, the applied magnetic field is decreased to finally obtain on a recording sheet a hysteresis curve of the sample. The saturation magnetization, residual magnetization and coercive force of the carrier are determined from the hysteresis curve.

3) Measurement of Number-Average Primary Particle Diameter of Particles on Carrier Particle Surfaces:

A sample is processed and observed using a focused ion beam (FIB) system FB-2000C (manufactured by Hitachi Ltd.). To prepare the sample, a sample stand is coated with an aqueous carbon paste fluid, and the sample (carrier) is placed thereon in a small quantity. Thereafter, the sample is set on the FIB system without vapor deposition of platinum, and the surface of the intended sample is irradiated with beams. Thus, the hills of unevenness coming from particles can be observed. The diameter of each hill portion is measured. This measurement is made at 3 spots picked up at random from among photographed 20 carrier particle sections each, i.e., at 60 spots in total, and their average value calculated from the measurements is regarded as the number-average primary particle diameter of particles.

4) Measurement of Apparent Density of Carrier:

The apparent density of the carrier is measured using a container attached to a powder tester manufactured by Hosokawa Micron Corporation, and according to procedure described in the instruction manual of the powder tester to measure the apparent density.

5) Measurement of Degree of Surface Unevenness of Carrier:

The degree of surface unevenness of the carrier and carrier cores is calculated in the following way, using a multi-image analyzer (manufactured by Beckman Coulter, Inc.).

The multi-image analyzer is an instrument for measuring particle size distribution by the electrical-resistance method which instrument is combined with the function to photograph particle images by using a CCD (charge coupled device) camera and the function to imagewise analyze the particle images photographed. Stated in detail, particles to be measured which have uniformly been dispersed in an electrolytic solution by the aid of ultrasonic waves or the like are detected by changes in electrical resistance which are caused when the particles pass through an aperture of Multisizer, the instrument for measuring particle size distribution by the electrical-resistance method, and strobes are emitted in synchronization therewith to photograph the particle images by using the CCD camera. The particle images photographed are keyed into a personal computer, which are then binary-coded to thereafter make image analysis.

This instrument can analyze from the particle images not only the particle size data of circle-equivalent diameter, maximum length, surface area and sphere-equivalent diameter but also various particle shapes such as average circularity, degree of surface unevenness, aspect ratio, and ratio of envelope circumferential length to circumferential length. Further, how to introduce the sample is a continuous type, and hence, in the case of magnetic carriers, having a large specific gravity, readily settling and also not easily dispersible in solutions, the measurement can be made in a good reproducibility.

The degree of surface unevenness of the carrier and carrier cores is found according to the following expression (1). The closer to a circle the particle is, the closer to 1 the value is. The slender the particle is, the larger value comes.

Degree of surface unevenness=Perimeter$^2$/(4×Area×π).

Area: Surface area; and

Perimeter: Circumferential length.

A specific method of measurement is as follows:

First, few drops of a surface-active agent is added to 100 to 300 ml of water from which fine dust has been removed through a filter. A sample (carrier or carrier cores) for measurement is added thereto in an appropriate quantity (e.g., 2 to 50 mg), and dispersion treatment is carried out for 3 minutes by means of an ultrasonic dispersion machine to make measurement using a sample dispersion prepared with adjustment of particle concentration of the sample for measurement. The pulses of changes in electrical resistance which are caused when the particles pass through an aperture of 10 μm in size serve as triggers to emit strobes, where the particle images are photographed by using the CCD camera. In this photographing, the height of pulses of changes in electrical resistance which is not less than a certain value is regarded as a threshold, and pulses having a height of not less than this threshold are made to serve as trigger signals for emitting strobes. Here, the threshold must be so set that particles of 3 μm or more in circle-equivalent diameter can surely be photographed. In order to heighten the precision of the emission of strobes that is synchronous with the pass of particles, to obtain particle images with less blurs, the number of times of the synchronous emission of strobes (i.e., particle image photographing speed) must be set not less than 60 times/second. Also, the number of particles to be passed through the aperture may preferably be controlled by controlling sample dispersion concentration, stirring conditions and so forth so as for the number of times of the synchronous emission of strobes to be 30 times/second. In practice, the measurement is made setting the particle image photographing speed to be 10 to 20 particles/second.

To photograph the particle images, a CCD camera having effective pixels of about 300,000 in number is used via an optical system having an optical magnifying power of 40, in combination of an objective lens of 20 magnifications and a converter lens of 2 magnifications. It has a resolving power of about 0.25 μm/1 pixel. The particle images photographed are keyed into a personal computer, which are then binary-coded to thereafter make image analysis. Through the image analysis, the particle shape data of the degree of surface unevenness are obtained.

6) Measurement of Weight-Average Particle Diameter of Toner:

In the present invention, the weight-average particle diameter and particle size distribution of the toner may be measured with Coulter counter TA-II or Coulter Multisizer (manufactured by Coulter Electronics, Inc.). As an electrolytic solution, an aqueous 1% NaCl solution is prepared using first-grade sodium chloride. In the present invention, ISOTON R-II (available from Coulter Scientific Japan Co.) is used. As a measuring method, 0.1 to 5 ml of a surface active agent, preferably an alkylbenzenesulfonate, is added as a dispersant to 100 to 150 ml of the above aqueous electrolytic solution, and 2 to 20 mg of a sample (toner) for measurement is further added. The electrolytic solution in which the sample has been suspended is subjected to dispersion treatment for about 1 minute to about 3 minutes in an ultrasonic dispersion machine. The volume distribution and number distribution are calculated by measuring the volume and number of toner particles of 2.00 μm or more in diameter by means of the above measuring instrument, using an aperture of 100 μm as its aperture. Then the weight average particle diameter (D4) (the middle value of each channel is used as the representative value for each channel) is determined.

As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to Less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

7) Measurement of Average Circularity of Toner:

The average circularity of the toner is measured with a flow type particle analyzer "FPIA-2100 Model" (manufactured by Sysmex Corporation), and is calculated using the following expressions.

Circle-equivalent diameter=(particle projected area/$\pi$)$^{1/2}$×2.

Circularity=Circumferential length of a circle with the same area as particle projected area Circumferential length of particle projected image.

Here, the "particle projected area" is meant to be the area of a binary-coded toner particle image, and the "circumferential length of particle projected image" is defined to be the length of a contour line formed by connecting edge points of the toner particle image. In the measurement, used is the circumferential length of a particle image in image processing at an image processing resolution of 512×512 (a pixel of 0.3 μm×0.3 μm).

The circularity referred to in the present invention is an index showing the degree of surface unevenness of toner particles. It is indicated as 1.000 when the toner particles are perfectly spherical. The more complicate the surface shape is, the smaller the value of circularity is.

As a specific way of measurement, first, 10 ml of ion-exchanged water from which impurity solid matter or the like has been removed is made ready in a container. A surface active agent, preferably an alkylbenzenesulfonate, is added thereto as a dispersant. Thereafter, 0.02 g of a sample for measurement is further added and uniformly dispersed. As a means for dispersing it, an ultrasonic dispersion mixer "TETORAL 50 Model" (manufactured by Nikkaki Bios Co.) is used, and dispersion treatment is carried out for 2 minutes to prepare a fluid dispersion for measurement. In that case, the fluid dispersion is appropriately cooled so that its temperature does not come to 40° C. or more. Also, in order to keep the circularity from scattering, the environment in which the flow type particle analyzer FPIA-2100 is installed is controlled at 23° C. plus-minus 0.5° C. so that the in-machine temperature of the analyzer can be kept at 26 to 27° C., and autofocus control is performed using 2 μm latex particles at intervals of constant time, and preferably at intervals of 2 hours.

In measuring the circularity of toner particles, the above flow type particle analyzer is used and the concentration in the liquid dispersion is again so controlled that the toner concentration at the time of measurement is 3,000 to 10,000 particles/μl, where 1,000 or more toner particles are measured. After the measurement, using the data obtained, the data of particles with a circle-equivalent diameter of less than 2 μm are cut, and the average circularity of the particles is determined.

Carriers used in the present invention are shown below.

Production Example of Carrier Cores 1

12.9 mole % of LiO, 6.5 mole % of MgO and 80.6 mole % of $Fe_2O_3$, and further 0.02 mole % of MnO and 0.002 mole % of CuO, were pulverized and mixed by means of a wet-process ball mill, followed by drying. Thereafter, this was held at 900° C. for 1 hour to effect calcination. The resultant calcined product was pulverized for 7 hours by means of the wet-process ball mill, into particles of 3 μm or less in diameter. To the resultant slurry of the calcined product, a dispersant and a binder (polyvinyl alcohol) were added in an amount of 2.5% by weight in total, followed by granulation and drying by means of a spray dryer. The granulated product obtained was held at 1,200° C. for 4 hours in an electric furnace to carry out main firing. Thereafter, the fired product was disintegrated, sieved with a sieve of 250 μm in mesh opening to remove coarse particles, and then further classified by means of an air classifier (Elbow Jet, manufactured by Nittetsu Mining Co., Ltd.) to control particle size. Thus, Carrier Cores 1 were obtained, having weight-average particle diameter of 38.2 μm. Components and physical properties of the carrier cores obtained are shown in Table 1.

Production Examples of Carrier Cores 2 to 6

Carrier Cores 2 to 6 were obtained in the same manner as the production of Carrier Cores 1 except that the carrier composition was changed as shown in Table 1. Components and physical properties of the carrier cores obtained are shown in Table 1.

Production Examples of Carrier Cores 7 and 8

Carrier Cores 7 and 8 were obtained in the same manner as the production of Carrier Cores 5 except that conditions for the particle size control were changed. Components and physical properties of the carrier cores obtained are shown in Table 1.

Production Examples of Carrier Cores 9 and 10

Carrier Cores 9 and 10 were obtained in the same manner as the production of Carrier Cores 6 except that the carrier composition was changed as shown in Table 1 and the amounts of heavy-metal oxides were also changed as shown in Table 1. Components and physical properties of the carrier cores obtained are shown in Table 1.

Because of the difference in the amounts of heavy-metal components, Carrier Cores 9 came highly magnetized, and also Carrier Cores 10 contained some irregular-shaped particles.

Production Examples of Carrier Cores 11 and 12

Carrier Cores 11 and 12 were obtained in the same manner as the production of Carrier Cores 1 except that the carrier composition was changed as shown in Table 1 and the amounts of light-metal oxides were also changed as shown in Table 1. Components and physical properties of the carrier cores obtained are shown in Table 1.

Production Examples of Carrier Cores 13 and 14

Carrier Cores 13 and 14 were obtained in the same manner as the production of Carrier Cores 1 except that conditions for the particle size control were changed. Components and physical properties of the carrier cores obtained are shown in Table 1.

Production Examples of Carrier Cores 15

Carrier Cores 15 were obtained in the same manner as the production of Carrier Cores 1 except that the carrier composition was changed as shown in Table 1 and the amounts of heavy-metal oxides were also changed as shown in Table 1. Components and physical properties of the carrier cores obtained are shown in Table 1.

Because of the difference in the amounts of heavy-metal components, Carrier Cores 15 came highly magnetized.

TABLE 1

Carrier Core Constituent Materials and Physical Properties

| Carrier cores | Composition: Li oxide (mol %) | Mg oxide (mol %) | Ca oxide (mol %) | Light = metal oxide component content (mol %) | $Fe_2O_3$ (mol %) | Mn oxide (ppm) | Cu oxide (ppm) | Core particle diameter (μm) | Saturation magnetization ($Am^2/kg$) | Residual magnetization ($Am^2/kg$) | Degree of surface unevenness |
|---|---|---|---|---|---|---|---|---|---|---|---|
| 1 | 12.9 | 6.5 | — | 19.4 | 80.6 | 2,500 | 235 | 38.2 | 60 | 4 | 1.26 |
| 2 | 5.2 | 6.8 | 5.4 | 17.4 | 82.6 | 2,600 | 300 | 38.6 | 62 | 3 | 1.25 |
| 3 | 21.3 | 12.5 | — | 33.8 | 66.2 | 2,900 | 280 | 39.1 | 59 | 4 | 1.31 |
| 4 | 4.1 | 4.9 | 4.2 | 13.2 | 86.8 | 2,700 | 260 | 39.4 | 61 | 2 | 1.25 |
| 5 | 38.7 | — | — | 38.7 | 61.3 | 2,600 | 280 | 40.5 | 58 | 5 | 1.33 |
| 6 | — | 10.2 | — | 10.2 | 89.8 | 2,200 | 240 | 40.1 | 67 | 4 | 1.21 |
| 7 | 38.7 | — | — | 38.7 | 61.3 | 2,100 | 260 | 54.2 | 58 | 5 | 1.38 |
| 8 | 38.7 | — | — | 38.7 | 61.3 | 2,100 | 260 | 16.8 | 58 | 5 | 1.29 |
| 9 | — | 10.2 | — | 10.2 | 89.8 | 3,900 | 3,100 | 40.3 | 72 | 4 | 1.21 |
| 10 | — | 10.2 | — | 10.2 | 89.8 | 50 | 0 | 40.7 | 67 | 4 | 1.21 |
| 11 | — | 9.0 | — | 9.0 | 91.0 | 2,400 | 230 | 40.6 | 65 | 3 | 1.25 |
| 12 | 35.8 | — | 5.6 | 41.4 | 58.6 | 2,300 | 220 | 40.7 | 54 | 7 | 1.38 |
| 13 | 12.9 | 6.5 | — | 19.4 | 80.6 | 2,300 | 220 | 56.1 | 60 | 4 | 1.36 |
| 14 | 12.9 | 6.5 | — | 19.4 | 80.6 | 2,300 | 220 | 14.8 | 60 | 4 | 1.03 |
| 15 | 12.9 | 6.5 | — | 19.4 | 80.6 | 4,300 | 4,100 | 43.7 | 78 | 3 | 1.26 |

Production Example of Carrier 1

| | (by weight) |
|---|---|
| Straight silicone (KR255, available from Shin-Etsu Chemical Co., Ltd; in terms of solid content) | 100 parts |
| Silane type coupling agent (γ-aminopropylethoxysilane) | 10 parts |
| Polymethyl methacrylate resin (1) (volume-average particle diameter: 100 nm) | 20 parts |

The above components were mixed with 300 parts by weight of xylene to prepare a carrier resin coat fluid. Using this resin coat fluid and with agitation by using a fluidized bed heated to 70° C., coating on and solvent removal from Carrier Cores 1 were so operated that resin coat was in a solid content of 1.5% by weight. Further, using an oven, the coated product obtained was treated at 230° C. for 2.5 hours, followed by disintegration and then classification using a sieve. The classified carrier was further finally put into Nauta mixer and agitated at 100 rpm for 30 minutes to obtain Carrier 1.

Production Examples of Carriers 2 to 4

Carriers 2 to 4 were obtained in the same manner as the production of Carrier 1 except that the carrier cores were changed as shown in Table 2. Components and physical properties of the carrier obtained are shown in Table 2.

Production Examples of Carriers 5 and 6

Carriers 5 and 6 were obtained in the same manner as the production of Carrier 1 except that the carrier cores were changed as shown in Table 2 and polymethyl methacrylate resin (2) (volume-average particle diameter: 55 nm) was used in place of the polymethyl methacrylate resin (1). Components and physical properties of the carrier obtained are shown in Table 2.

Production Example of Carrier 7

| | (by weight) |
|---|---|
| Fluorine-acrylic resin (perfluorooctylethyl acrylate-methyl methacrylate resin) | 100 parts |
| Fine melamine resin particles (volume-average particle diameter: 350 nm) | 30 parts |

The above components were mixed with 300 parts by weight of xylene to prepare a carrier resin coat fluid. Using this resin coat fluid and with agitation by using a fluidized bed heated to 70° C., coating on and solvent removal from Carrier Cores 5 were so operated that the resin coat was in a solid content of 0.6% by weight. Further, using an oven, the coated product obtained was treated at 230° C. for 2.5 hours, followed by disintegration and then classification using a sieve to obtain Carrier 7.

Production Example of Carrier 8

| | (by weight) |
|---|---|
| Fluorine-acrylic resin (perfluorooctylethyl acrylate-methyl methacrylate resin) | 100 parts |
| Fine melamine resin particles (volume-average particle diameter: 350 nm) | 30 parts |

The above components were mixed with 300 parts by weight of xylene to prepare a carrier resin coat fluid. Using this resin coat fluid and with agitation by using a fluidized bed heated to 70° C., coating on and solvent removal from Carrier Cores 6 were so operated that the resin coat was in a solid content of 0.6% by weight. Further, using an oven, the coated product obtained was treated at 230° C. for 2.5 hours, followed by disintegration and then classification using a sieve. The classified carrier was further finally put into Nauta mixer and agitated at 100 rpm for 30 minutes to obtain Carrier 8.

Production Examples of Carriers 9 to 12

Carriers 9 to 12 were obtained in the same manner as the production of Carrier 8 except that the carrier cores were changed as shown in Table 2. Components and physical properties of the carrier obtained are shown in Table 2.

Production Example of Carrier 13

Carrier 13 was obtained in the same manner as the production of Carrier 1 except that polymethyl methacrylate resin (3) (volume-average particle diameter: 9 nm) was used in place of the polymethyl methacrylate resin (1). Components and physical properties of the carrier obtained are shown in Table 2.

Production Example of Carrier 14

Carrier 14 was obtained in the same manner as the production of Carrier 1 except that polymethyl methacrylate resin (4) (volume-average particle diameter: 520 nm) was used in place of the polymethyl methacrylate resin (1). Components and physical properties of the carrier obtained are shown in Table 2.

Production Examples of Carriers 15 to 19

Carriers 15 to 19 were obtained in the same manner as the production of Carrier 1 except that the carrier cores were changed as shown in Table 2. Components and physical properties of the carrier obtained are shown in Table 2.

Production Example of Carrier 20

Carrier 20 was obtained in the same manner as the production of Carrier 1 except that the polymethyl methacrylate resin (1) was not used. Components and physical properties of the carrier obtained are shown in Table 2.

TABLE 2

Carrier Coat Formulation and Carrier Physical Properties

| Carrier | Carrier cores | Carrier coating resin Type | Carrier coating resin Amt. (wt. %) | Silane coupling agent Amt. (wt. %) | Fine resin particles Type | Fine resin particles Amt. (wt. %) | Mechanical treatment after carrier coating | Carrier physical properties *1: Primary av. particle diam. (nm) | Apparent density (g/cm$^3$) | Degree of surface unevenness | Volume = av. particle diam. (μm) |
|---|---|---|---|---|---|---|---|---|---|---|---|
| 1 | 1 | Silic. | 1.5 | 0.15 | PPMA(1) | 0.30 | Yes | 100 | 2.08 | 1.15 | 38.2 |
| 2 | 2 | Silic. | 1.5 | 0.15 | PPMA (1) | 0.30 | Yes | 100 | 2.01 | 1.16 | 38.6 |
| 3 | 3 | Silic. | 1.5 | 0.15 | PPMA (1) | 0.30 | Yes | 100 | 1.89 | 1.20 | 39.1 |
| 4 | 4 | Silic. | 1.5 | 0.15 | PPMA (1) | 0.30 | Yes | 100 | 1.93 | 1.13 | 39.4 |
| 5 | 3 | Silic. | 1.5 | 0.15 | PPMA (2) | 0.30 | Yes | 55 | 1.87 | 1.28 | 39.1 |
| 6 | 4 | Silic. | 1.5 | 0.15 | PPMA (2) | 0.30 | Yes | 55 | 1.90 | 1.19 | 39.4 |
| 7 | 5 | F-acr. | 0.6 | — | Melamine | 0.18 | No | 350 | 1.83 | 1.29 | 40.5 |
| 8 | 6 | F-acr. | 0.6 | — | Melamine | 0.18 | Yes | 350 | 1.94 | 1.09 | 40.1 |
| 9 | 7 | F-acr. | 0.6 | — | Melamine | 0.18 | Yes | 350 | 2.21 | 1.29 | 54.2 |
| 10 | 8 | F-acr. | 0.6 | — | Melamine | 0.18 | Yes | 350 | 2.34 | 1.23 | 16.8 |
| 11 | 9 | F-acr. | 0.6 | — | Melamine | 0.18 | Yes | 350 | 1.91 | 1.13 | 40.3 |
| 12 | 10 | F-acr. | 0.6 | — | Melamine | 0.18 | Yes | 350 | 1.90 | 1.17 | 40.7 |
| 13 | 1 | Silic. | 1.5 | 0.15 | PPMA (3) | 0.30 | Yes | 9 | 2.07 | 1.22 | 38.2 |
| 14 | 1 | Silic. | 1.5 | 0.15 | PPMA (4) | 0.30 | Yes | 520 | 2.10 | 1.31 | 38.2 |
| 15 | 11 | Silic. | 1.5 | 0.15 | PPMA (1) | 0.30 | Yes | 100 | 2.15 | 1.14 | 40.6 |
| 16 | 12 | Silic. | 1.5 | 0.15 | PPMA (1) | 0.30 | Yes | 100 | 1.79 | 1.23 | 40.7 |
| 17 | 13 | Silic. | 1.5 | 0.15 | PPMA (1) | 0.30 | Yes | 100 | 2.41 | 1.25 | 56.1 |
| 18 | 14 | Silic. | 1.5 | 0.15 | PPMA (1) | 0.30 | Yes | 100 | 1.28 | 1.04 | 14.8 |
| 19 | 15 | Silic. | 1.5 | 0.15 | PPMA (1) | 0.30 | Yes | 100 | 2.15 | 1.11 | 43.7 |
| 20 | 1 | Silic. | 1.5 | 0.15 | — | — | Yes | — | 2.08 | 1.24 | 38.2 |

*1: of particles in coat layers
Silic.: Silicone resin;
F-acr.: Fluorine-acrylic resin
PMMA: Polymethyl methacrylate resin;
Melamine: Melamine resin Toner Production Example 1

Into 710 parts by weight of ion-exchanged water, 450 parts by weight of an aqueous 0.1M $Na_3PO_4$ solution was introduced. The mixture formed was heated to 60° C., and thereafter stirred at 12,000 rpm by means of a TK-type homomixer (manufactured by Tokushu Kika Kogyo Co., Ltd.). Then, 68 parts by weight of an aqueous 1.0M $CaCl_2$ solution was slowly added thereto to obtain an aqueous medium containing $Ca_3(PO_4)_2$.

| | (by weight) |
|---|---|
| Styrene | 165 parts |
| n-Butyl acrylate | 35 parts |
| C.I. Pigment Blue 15:3 (colorant) | 12 parts |
| 2,5-Ditertiarybutylsalicylic acid aluminum compound (charge control agent) | 3 parts |
| Saturated polyester resin (weight-average molecular weight: 17,000; glass transition temperature: 54° C.; acid value: 19.9; hydroxyl value: 7.5) | 10 parts |
| Ester wax (total carbon atoms: 36; melting point: 70° C.) | 20 parts |

Meanwhile, the above materials were heated to 60° C. and were uniformly dissolved or dispersed at 11,000 rpm by means of a TK-type homomixer (manufactured by Tokushu Kika Kogyo Co., Ltd.). To the dispersion obtained, 10 parts by weight of a polymerization initiator 2,2'-azobis(2,4-dimethylvaleronitrile) to prepare a polymerizable monomer composition.

The polymerizable monomer composition was introduced into the above aqueous medium and then stirred at 11,000 rpm for 10 minutes by means of the TK-type homomixer at 60° C.

in an atmosphere of $N_2$ to granulate the polymerizable monomer composition. Thereafter, with stirring using paddle stirring blades, the temperature was raised to 80° C. to carry out the reaction for 10 hours. After the polymerization reaction was completed, residual monomers were evaporated off under reduced pressure and the reaction mixture was cooled. Thereafter, hydrochloric acid was added to dissolve the $Ca_3(PO_4)_2$ and so forth, followed by filtration, water washing and drying to obtain cyan toner particles.

To 100 parts by weight of the cyan toner particles thus obtained, 0.5 part by weight of hydrophobic-treated fine silica powder (number-average particle diameter of primary particles: 0.03 μm) and 0.5 part by weight of hydrophobic-treated fine titania powder (number-average particle diameter of primary particles: 0.03 μm) were externally added to obtain a cyan toner, Toner 1, having a weight-average particle diameter of 6.8 μm. This Toner 1 also had an average circularity of 0.973.

Toner Production Example 2

| | (by weight) |
|---|---|
| Polyester resin (condensation polymer of propoxylated bisphenol A with fumaric acid and trimellitic acid) | 100 parts |
| C.I. Pigment Blue 15:3 | 5 parts |
| Aluminum compound of dialkylsalicylic acid | 3 parts |
| Polyolefin wax | 5 parts |

The above materials were mixed using Henschel mixer, and then melt-kneaded by means of a twin-screw extruder while sucking the kneaded product through a vent port connected to a suction pump. The kneaded product obtained was crushed by means of a hammer mill to obtain a 1 mm mesh-pass crushed product. The crushed product was further finely pulverized by means of a jet mill, followed by classification by means of a multi-division classifier (Elbow Jet) and then heat sphering treatment using Surfusion System (manufactured by Nippon Pneumatic Mfg. Co. Ltd.) to obtain cyan toner particles.

In 100 parts by weight of the cyan toner particles thus obtained, 0.8 parts by weight of hydrophobic-treated fine titanium oxide powder (number-average particle diameter of primary particles: 0.05 μm) and 0.8 part by weight of hydrophobic-treated fine silica powder (number-average particle diameter of primary particles: 0.03 μm) were mixed using Henschel mixer to obtain a cyan toner, Toner 2, having a weight-average particle diameter of 6.6 μm. This Toner 2 also had an average circularity of 0.940.

Example 1

Carrier 1 (93 parts by weight) and the cyan toner Toner 1 (7 parts by weight) which were obtained as above were blended at 38 rpm for 3 minutes by means of a V-type mixer to prepare Developer 1.

Next, this Developer 1 was evaluated in the following way. As an evaluation machine, iRC3200 (manufactured by CANON INC.) was used. A 8,000-sheet image reproduction test was conducted using CLC 80 g paper (available from CANON SALES CO., INC.), in a monochromatic mode, in a normal-temperature and normal-humidity environment (23° C/60% RH; hereinafter also "N/N") and using an original having a low image area percentage of 3%, to make evaluation, and thereafter a 2,000-sheet image reproduction test was further conducted in the same way but using an original having a high image area percentage of 20%, to make evaluation. The like evaluation was also made in a high-temperature and high-humidity environment (32.5° C./90% RH; hereinafter also "H/H"). The evaluation was made by the following evaluation methods. The results of evaluation are shown in Table 3. Running performance was good, and also the environmental difference in triboelectricity was small.

—Evaluation Methods and Criteria—

Figure 3:
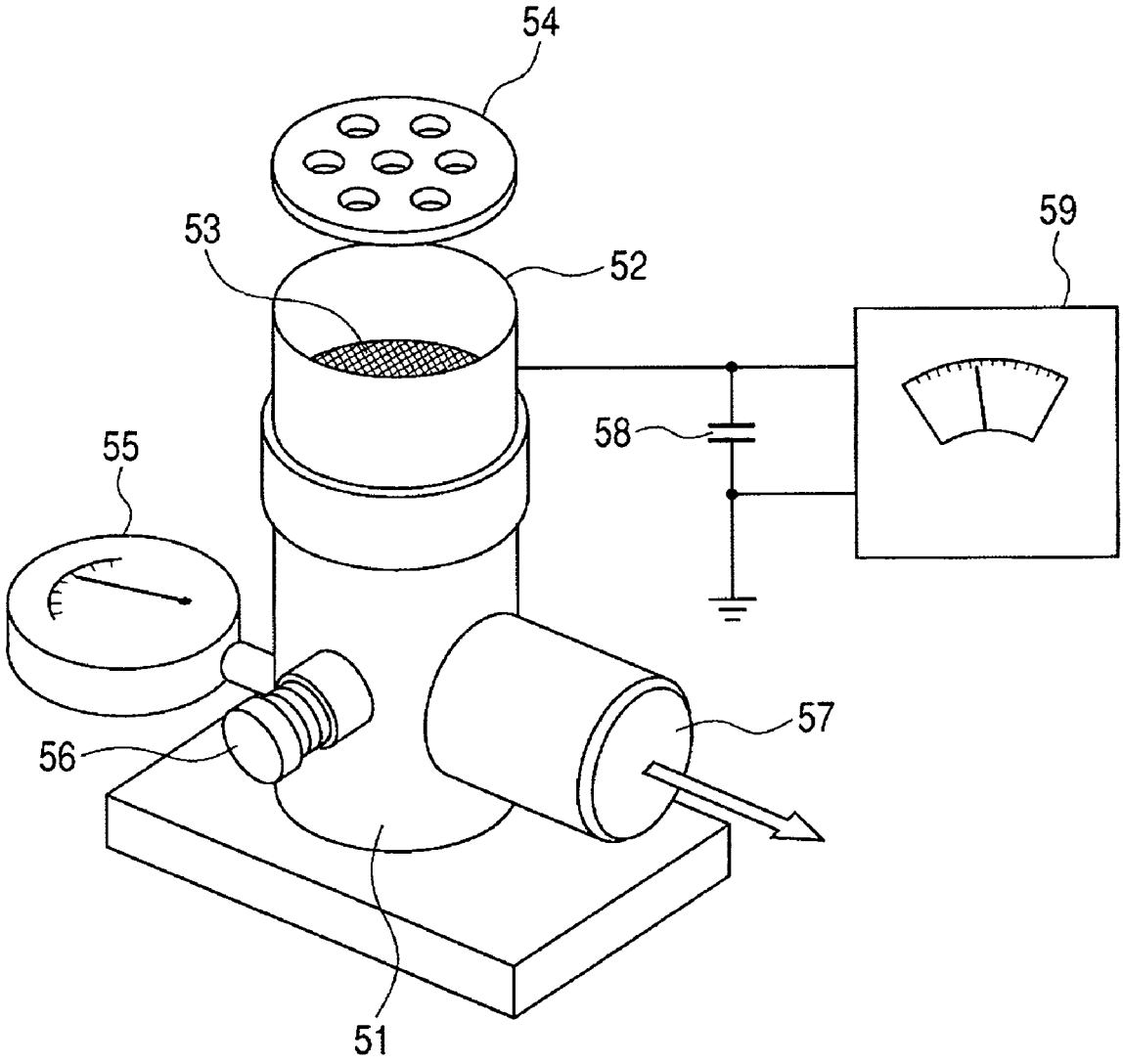
FIG. 3 is a schematic illustration of an instrument for measuring triboelectric charge quantity of a toner.

1) Measurement of Tribielectric Charge Quantity of Toner:

A device for measuring triboelectric charge quantity is schematically illustrated in FIG. 3. About 0.5 to 1.5 g of a two-component developer collected from the developing sleeve surface of a copying machine-or a printer is put into a measuring container 52 made of a metal at the bottom of which a screen 53 of 635 meshes is provided, and the container is covered with a plate 54 made of a metal. The total weight of the measuring container 52 at this point is weighed and is expressed as W1 (g). Next, in a suction device 51 (made of an insulating material at least at the part coming into contact with the measuring container 52), air is sucked from a suction opening 57 and an air-flow control valve 56 is operated to control the pressure indicated by a vacuum indicator 55, to be 250 mmAq. In this state, suction is sufficiently carried out, preferably for about 2 minutes, to remove the toner by suction. The potential indicated by a potentiometer 59 at this point is expressed as V (volt). Here, reference numeral 58 denotes a capacitor, whose capacitance is expressed as C (mF). The total weight of the measuring container after the suction is also weighed and is expressed as W2 (g). The triboelectric charge quantity (mC/kg) of this sample is calculated as in the following expression.

$$\text{Triboelectric charge quantity (mC/kg) of sample} = C \times V/(W1 - W2).$$

(Here, measuring conditions are set to be 23° C., 60% RH.)

2) Fog:

Fog was measured at the point of 10,000 sheets in the paper feed running test in the environments of N/N and H/H. As a method therefor, the average reflectance Dr (%) on plain paper before image reproduction was measured with a reflection densitometer (REFLECTOMETER MODEL TC-6DS, manufactured by Tokyo Denshoku Co., Ltd.) having a filter of complementary color to each color. Meanwhile, a solid white image was reproduced on plain paper, and then the reflectance Ds (%) of the solid white image was measured. Fog (%) was calculated from the following equation:

$$\text{Fog (\%)} = Dr(\%) - Ds(\%).$$

Evaluated according to the following criteria.

A: Less than 0.4%; very good.

B: From 0.4% or more to less than 1.0%; good.

C: F rom 1.0% or more to less than 1.6%; at a level tolerable in practical use.

D: From 1.6% or more to less than 2.2%: member contamination occurs.

E: 2.2% or more; at a level making practical use difficult.

3) Evaluation on Carrier Adhesion:

Using iRC3200 (manufactured by CANON INC.), an A4 whole-area solid halftone image was continuously reproduced on 5 sheets of CLC 80 g paper (available from CANON SALES CO., INC.), at development contrast which was so adjusted that the amount of toner at development on the drum came to 0.3 mg/cm$^2$. The number of blank dots appearing here in a size corresponding to carrier particle diameter was counted, and the count was expressed by what was averaged per sheet of A4 paper.

Blank-Dot Ranks

A: No blank dot at all, as being good.

B: Less than 0.5, as being good.

C: More than 0.5 to 1 or less.

D: More than 1 to 2 or less.

E: More than 2.

4) Halftone Image Uniformity:

To evaluated image density, in the N/N environment and using iRC3200 (manufactured by CANON INC.), an A4 whole-area solid halftone image was reproduced on CLC 80 g paper (available from CANON SALES CO., INC.), at development contrast which was so adjusted that the amount of toner at development on the drum came to 0.3 mg/cm$^2$. At that time, the image densities of the reproduced image were measured with a reflection densitometer RD918 (manufactured by Macbeth Co.) at the five spots.

To evaluate the halftone image uniformity, the difference between the maximum value and the minimum value in the image densities at the five spots as measured in the above evaluation of image density was found.

A: 0.04 or less.

B: More than 0.04 to 0.08 or less.

C: More than 0.08 to 0.12 or less.

D: More than 0.12.

E: Non-uniformity coming from sweep marks is seen in the images.

5) Difference of Triboelectricity in Environment:

The difference in initial-stage triboelectricity between the N/N environment and the H/H environment was measured.

A: The difference in triboelectricity is 5 or less.

B: The difference in triboelectricity is 5 or more to less than 10.

C: The difference in triboelectricity is 10 or more to less than 15.

D: The difference in triboelectricity is 15 or more to less than 20.

E: The difference in triboelectricity is 20 or more.

Examples 2 to 12

Developers 2 to 12 were produced in the same manner as the production of Developer 1 except that the carriers were changed as shown in Table 3. Evaluation was made in the same way. The results are shown in Table 3.

Example 13

Developer 13 was produced in the same manner as the production of Developer 12 except that the toner was changed as shown in Table 3. Evaluation was made in the same way. The results are shown in Table 3.

Comparative Examples 1 to 8

Developers 14 to 21 were produced in the same manner as the production of Developer 1 except that the carriers were changed as shown in Table 3. Evaluation was made in the same way. The results are shown in Table 3.

TABLE 3 (A)

| | | | | Evaluation Results | | | | |
|---|---|---|---|---|---|---|---|---|
| | | | | Normal-temperature and normal-humidity environment | | | | |
| | | | | | Charge quantity | | | |
| | Developer | Toner | Carrier | Initial = stage tribo-electricity (mC/kg) | Low image area percentage/ 8,000 sheets (mC/kg) | High image area percentage/ 10,000 sheets | Running performance | Fog (%) |
| Example: | | | | | | | | |
| 1 | 1 | 1 | 1 | −25.3 | −25.1 | −24.0 | A | A (0.2) |
| 2 | 2 | 1 | 2 | −24.2 | −23.8 | −23.0 | A | A (0.3) |
| 3 | 3 | 1 | 3 | −26.4 | −26.0 | −25.2 | A | A (0.3) |
| 4 | 4 | 1 | 4 | −24.5 | −24.0 | −22.1 | A | A (0.3) |
| 5 | 5 | 1 | 5 | −27.2 | −23.1 | −23.1 | A | B (0.4) |
| 6 | 6 | 1 | 6 | −27.7 | −21.2 | −21.0 | B | B (0.7) |
| 7 | 7 | 1 | 7 | −26.5 | −21.1 | −19.1 | B | B (0.5) |
| 8 | 8 | 1 | 8 | −26.7 | −25.7 | −22.1 | B | A (0.3) |
| 9 | 9 | 1 | 9 | −27.4 | −25.3 | −21.3 | B | B (0.9) |
| 10 | 10 | 1 | 10 | −30.6 | −22.1 | −21.3 | B | A (0.3) |
| 11 | 11 | 1 | 11 | −28.1 | −27.1 | −19.3 | B | B (0.9) |
| 12 | 12 | 1 | 12 | −29.2 | −19.6 | −15.5 | C | B (0.9) |
| 13 | 13 | 2 | 12 | −27.3 | −18.3 | −15.2 | C | C (1.2) |
| Comparative Example: | | | | | | | | |
| 1 | 14 | 1 | 13 | −37.5 | — | — | — | — |
| 2 | 15 | 1 | 14 | −26.7 | −14.5 | −12.1 | D | D (1.6) |
| 3 | 16 | 1 | 15 | −26.3 | −14.4 | −11.1 | D | D (2.1) |
| 4 | 17 | 1 | 16 | −30.9 | −14.5 | −13.1 | D | d (2.0) |
| 5 | 18 | 1 | 17 | −26.7 | −14.5 | −12.1 | D | D (1.7) |
| 6 | 19 | 1 | 18 | −26.7 | −14.5 | −12.1 | D | D (2.1) |
| 7 | 20 | 1 | 19 | −26.7 | −14.5 | −12.1 | D | D (2.0) |
| 8 | 21 | 1 | 20 | −37.2 | — | — | — | — |

TABLE 3 (B)

| | Evaluation Results | | | | | | | |
|---|---|---|---|---|---|---|---|---|
| | High-temperature and high-humidity environment | | | | | | | |
| | | Charge quantity | | | | | | |
| | Initial = stage tribo-electricity (mC/kg) | Low image area percentage/ 8,000 sheets (mC/kg) | High image area percentage/ 10,000 sheets (mC/kg) | Running performance | Fog | Difference of Tribo-electricity in environment (Δ) (%) | Half-tone image uniformity | Carrier adhesion |
| Example: | | | | | | | | |
| 1 | −20.6 | −19.5 | −19.7 | A | A (0.3) | A (4.7) | A (0.02) | A |
| 2 | −19.6 | −17.0 | −13.3 | A | A (0.2) | A (4.6) | A (0.03) | A |
| 3 | −19.0 | −18.6 | −14.8 | A | A (0.2) | B (7.4) | A (0.04) | A |
| 4 | −18.9 | −17.4 | −15.1 | A | B (0.6) | B (5.6) | A (0.02) | A |
| 5 | −17.6 | −15.6 | −14.0 | A | B (0.4) | B (9.6) | A (0.04) | A |
| 6 | −19.0 | −15.3 | −14.3 | B | C (1.0) | B (8.7) | A (0.04) | A |
| 7 | −17.8 | −13.8 | −12.2 | C | C (1.1) | B (8.7) | A (0.03) | C |
| 8 | −18.3 | −18.7 | −14.7 | B | B (0.5) | B (8.4) | C (0.09) | A |
| 9 | −17.5 | −16.1 | −12.1 | C | C (0.6) | B (9.9) | B (0.07) | A |
| 10 | −23.6 | −15.2 | −13.2 | C | B (0.5) | B (7.0) | A (0.04) | C |
| 11 | −18.2 | −16.9 | −11.9 | C | B (0.9) | B (9.9) | C (0.12) | A |
| 12 | −19.1 | −13.4 | −10.1 | C | C (1.2) | C (10.1) | B (0.07) | C |
| 13 | −15.6 | −13.1 | −9.8 | C | C (1.5) | C (11.7) | B (0.08) | C |
| Comparative Example: | | | | | | | | |
| 1 | −15.3 | — | — | — | — | E (22.2) | A (0.02) | A |
| 2 | −18.9 | −8.8 | −7.6 | D | E (3.0) | B (7.8) | A (0.02) | E |
| 3 | −19 | −8.5 | −7.6 | D | E (2.9) | B (7.3) | E | A |
| 4 | −15.9 | −8.8 | −7.6 | D | E (3.2) | D (15.0) | B (0.07) | A |
| 5 | −17.1 | −8.2 | −6.6 | D | E (3.1) | B (9.6) | B (0.08) | A |
| 6 | −16.3 | −8.8 | −7.3 | D | E (3.4) | C (10.4) | B (0.08) | E |
| 7 | −18.9 | −9.1 | −7.4 | D | E (3.5) | B (7.8) | D (0.13) | A |
| 8 | −14.9 | — | — | — | — | E (22.3) | A (0.02) | A |

Example 14

To 1.0 part by weight of Carrier 1, 7.0 parts by weight of Toner 1 was added, and these were blended by means of Turbla mixer to prepare Replenishing Developer 1.

This Replenishing Developer 1 and the above Developer 1 were used in the black station of a commercially available image forming apparatus iRC3200 (manufactured by CANON INC.). In the N/N and H/H environments, a 50,000-sheet image reproduction test was conducted on CLC 80 g paper (available from CANON SALES CO., INC.), at development contrast which was so adjusted that the image density at the initial stage came to 1.40, in a monochromatic mode, and using an original having an image area percentage of 5%, to make evaluation. As the result, image density and charging were found to be stable, and good results were obtained.

Further, in order to evaluate the stability of carrier concentration, 5 g of the replenishing developer was collected through the replenishing opening of the replenishing developer container at intervals of 1,000 sheets to measure carrier concentration in the replenishing developer. As the result, it was found that the carrier concentration was stable and the carrier of the present invention was able to bring out good dispersibility also as a carrier for the replenishing developer.

To detail how to measure the carrier concentration, 5 g of the replenishing developer was washed with ion-exchanged water in which 1% of CONTAMINON N (surface-active agent) was contained, to separate the toner from the carrier, followed by drying and then moisture conditioning (25.0° C./60% RH). Thereafter, the weight of the carrier contained in the replenishing developer was calculated to calculate the carrier concentration in the replenishing developer. Incidentally, the toner concentration (T/C ratio) in the developer container at the time of start was 8% by weight. A magnetic brush had the toner in an amount of 8 parts by weight based on 100 parts by weight of the carrier.

This application claims priority from Japanese Patent Application No. 2004-321564 filed Nov. 5, 2004, which is hereby incorporated by reference herein.

What is claimed is:

1. A carrier comprising carrier particles;

each carrier particle comprising a carrier core and a coat layer for coating the carrier core, wherein;

said carrier core has a ferrite component, and the ferrite component contains i) a metal oxide having at least one metallic element selected from the group consisting of Mg, Li and Ca, where the total-sum content of the metal oxide having at least one of the metallic elements Mg, Li and Ca is from 15 to 30 mole % based on the whole ferrite component, and ii) a metal oxide having at least one metallic element selected from the group consisting of Mn, Cu, Cr and Zn, where the total-sum content of the metal oxide having at least one of the metallic elements Mn, Cu, Cr and Zn is from 50 to 4,000 ppm on mass basis based on the whole ferrite component;

said carrier has a volume distribution based 50% particle diameter (D50) of from 15.0 μm to 55.0 μm;

said carrier has a degree of surface unevenness of from 1.05 to 1.30; and said coat layer contains particles, and the particles have a number-average primary particle diameter of from 10 nm to 500 nm.

2. The carrier according to claim 1, wherein said carrier core has a degree of surface unevenness of from 1.05 to 1.40.

3. The carrier according to claim 1, wherein said particles have a number-average primary particle diameter of from 50 nm to 300 nm.

4. The carrier according to claim 1, wherein said particles are crosslinkable-resin particles.

5. The carrier according to claim 1, which has a saturation magnetization of from 30 to 80 $Am^2/kg$, and a residual magnetization of 10 $Am^2/kg$ or less, under application of a magnetic field of 240 kA/m.

6. A two-component developer comprising a toner containing at least a binder resin and a colorant and a carrier comprising carrier particles;

each carrier particle comprising at least a carrier core and a coat layer for coating the carrier core, wherein;

said carrier core has a ferrite component, and the ferrite component contains i) a metal oxide having at least one metallic element selected from the group consisting of Mg, Li and Ca, where the total-sum content of the metal oxide having at least one of the metallic elements Mg, Li and Ca is from 15 to 30 mole % based on the whole ferrite component, and ii) a metal oxide having at least one metallic element selected from the group consisting of Mn, Cu, Cr and Zn, where the total-sum content of the metal oxide having at least one of the metallic elements Mn, Cu, Cr and Zn is from 50 to 4,000 ppm on mass basis based on the whole ferrite component;

said carrier has a volume distribution based 50% particle diameter (D50) of from 15.0 μm to 55.0 μm;

said carrier has a degree of surface unevenness of from 1.05 to 1.30; and said coat layer contains particles, and the particles have a number-average primary particle diameter of from 10 nm to 500 nm.

7. The two-component developer according to claim 6, wherein said toner has an average circularity of from 0.930 to 0.985.

8. The two-component developer according to claim 6, wherein said carrier core has a degree of surface unevenness of from 1.05 to 1.40.

9. The two-component developer-according to claim 6, wherein said particles have a number-average primary particle diameter of from 50 nm to 300 nm.

10. The two-component developer according to claim 6, wherein said particles are crosslinkable-resin particles.

11. The two-component developer according to claim 6, wherein said carrier has a saturation magnetization of from 30 to 80 $Am^2/kg$, and a residual magnetization of 10 $Am^2/kg$ or less, under application of a magnetic field of 240 kA/m.

12. The two-component developer according to claim 6, which contains the toner in an amount of from 200 parts by weight to 5,000 parts by weight based on 100 parts by weight of the carrier.

13. The two-component developer according to claim 12, which is a replenishing developer for use in an image forming method comprising replenishing a toner and a carrier, developing an electrostatic latent image with a magnetic brush formed of a toner and a carrier on a developer carrying member, to form a toner image, and discharging the carrier that has become excess in the interior of a developing assembly, out of the developing assembly.

14. An image forming method comprising:

a charging step of charging the surface of a photosensitive member electrostatically;

a latent-image forming step of forming an electrostatic latent image on the photosensitive member surface thus charged;

a developing step of feeding a toner to the electrostatic latent image by the action of an electric field formed between i) a two-component developer held in a developing unit and ii) the photosensitive member to render the electrostatic latent image visible to form a toner image;

a transfer step of transferring the toner image onto a transfer material via, or not via, an intermediate transfer member; and a fixing step of making the transfer material pass a nip formed by a fixing member and a pressure member pressed against the fixing member, to fix the toner image to the transfer material with heating and in pressure contact;

said steps being repeated to perform image formation; said charging step being carried out after a charge quantity control step has been carried out in which a transfer residual toner having remained on the photosensitive member surface after the transfer step is charged to a regular polarity; and the transfer residual toner being collected in said developing step; and said two-component developer having a toner containing at least a binder resin and a colorant and a carrier comprising carrier particles;

each carrier particle comprising at least a carrier core and a coat layer for coating the carrier core, wherein;

said carrier core has a ferrite component, and the ferrite component contains i) a metal oxide having at least one metallic element selected from the group consisting of Mg, Li and Ca, where the total-sum content of the metal oxide having at least one of the metallic elements Mg, Li and Ca is from 15 to 30 mole % based on the whole ferrite component, and ii) a metal oxide having at least one metallic element selected from the group consisting of Mn, Cu, Cr and Zn, where the total-sum content of the metal oxide having at least one of the metallic elements Mn, Cu, Cr and Zn is from 50 to 4,000 ppm on mass basis based on the whole ferrite component;

said carrier has a volume distribution based 50% particle diameter (D50) of from 15.0 μm to 55.0 μm;

said carrier has a degree of surface unevenness of from 1.05 to 1.30; and said coat layer contains particles, and the particles have a number-average primary particle diameter of from 10 nm to 500 nm.

15. An image forming method comprising forming an electrostatic latent image on an electrostatic latent image bearing member, forming a magnetic brush out of a toner and a carrier on a developer carrying member internally provided with a magnetic-field generating means, and developing the electrostatic latent image by means of the magnetic brush formed on the developer carrying member, to form a toner image on the electrostatic latent image bearing member;

said magnetic brush having the toner in an amount of from 2 parts by weight to 20 parts by weight based on 100 parts by weight of the carrier; a replenishing developer being fed to a developing assembly, and the carrier that has become excess in the interior of the developing assembly being discharged out of the developing assembly; and the replenishing developer being a two-component developer having a toner containing at least a binder resin and a colorant and a carrier comprising carrier particles;

each carrier particle comprising at least a carrier core and a coat layer for coating the carrier core, wherein;

said carrier core has a ferrite component, and the ferrite component contains i) a metal oxide having at least one metallic element selected from the group consisting of Mg, Li and Ca, where the total-sum content of the metal oxide having at least one of the metallic elements Mg, Li and Ca is from 15 to 30 mole % based on the whole ferrite component, and ii) a metal oxide having at least one metallic element selected from the group consisting of Mn, Cu, Cr and Zn, where the total-sum content of the metal oxide having at least one of the metallic elements Mn, Cu, Cr and Zn is from 50 to 4,000 ppm on mass basis based on the whole ferrite component;

said carrier has a volume distribution based 50% particle diameter (D50) of from 15.0 μm to 55.0 μm;

said carrier has a degree of surface unevenness of from 1.05 to 1.30; and said coat layer contains particles, and the particles have a number-average primary particle diameter of from 10 to 500 nm.

* * * * *